US012042060B2

(12) United States Patent
Jung et al.

(10) Patent No.: US 12,042,060 B2
(45) Date of Patent: Jul. 23, 2024

(54) LUMBAR SUPPORTING SYSTEM OF CHAIR AND CHAIR HAVING THE SAME

(71) Applicant: PATRA CO., LTD., Seoul (KR)

(72) Inventors: Jae Gyu Jung, Seoul (KR); Baek Joo Kang, Yongin-si (KR)

(73) Assignee: PATRA CO., LTD., Seoul (KR)

( * ) Notice: Subject to any disclaimer, the term of this patent is extended or adjusted under 35 U.S.C. 154(b) by 78 days.

(21) Appl. No.: 18/075,207

(22) Filed: Dec. 5, 2022

(65) Prior Publication Data

US 2023/0190001 A1 Jun. 22, 2023

(30) Foreign Application Priority Data

Dec. 16, 2021 (KR) ..... 10-2021-0180311

(51) Int. Cl.
*A47C 7/46* (2006.01)

(52) U.S. Cl.
CPC ..... *A47C 7/462* (2013.01); *A47C 7/46* (2013.01)

(58) Field of Classification Search
CPC ..... A47C 7/46; A47C 7/462
USPC ..... 297/284.4, 284.7
See application file for complete search history.

(56) References Cited

U.S. PATENT DOCUMENTS 5,112,106 A * 5/1992 Asbjornsen ..... A47C 7/46 297/284.7
6,938,956 B1 * 9/2005 Piretti ..... A47C 7/38 297/284.7
10,264,890 B2 * 4/2019 Aldrich ..... A47C 7/462
10,272,282 B2 * 4/2019 Harlow ..... A47C 7/746
10,827,841 B1 * 11/2020 Tsai ..... A47C 7/405
11,432,649 B2 * 9/2022 Beech ..... A47C 1/0242
2012/0193959 A1 * 8/2012 Chen ..... A47C 7/38 297/301.1
2012/0242130 A1 * 9/2012 Hung ..... A47C 7/46 297/344.18
2019/0209886 A1 * 7/2019 Harlow ..... A63B 21/04
2019/0281988 A1 * 9/2019 Su ..... A47C 7/46
2023/0075814 A1 * 3/2023 Beech ..... A47C 31/008
2023/0200536 A1 * 6/2023 Beech ..... A47C 31/008 297/463.1

FOREIGN PATENT DOCUMENTS

KR 20-0436742 Y1 9/2007
KR 20090124050 A * 12/2009 ..... A47C 7/46
KR 10-2010-0107288 A 10/2010
KR 10-2011-0043307 A 4/2011
KR 10-1384987 B1 4/2014
KR 102273376 B1 * 7/2021 ..... A47C 7/462
KR 102314380 B1 * 10/2021 ..... A47C 7/462

* cited by examiner

*Primary Examiner* — Rodney B White
(74) *Attorney, Agent, or Firm* — You & IP, LLC

(57) ABSTRACT

Disclosed is a lumbar supporting system of a chair and a chair having the same, and an object to be achieved by the present disclosure is to provide a lumbar supporting system of a chair and a chair having the same, which are capable of accurately supporting a user's waist according to the user's body type by adjusting a height and depth of a lumbar pad by using a vertical operating force.

20 Claims, 22 Drawing Sheets

LUMBAR SUPPORTING SYSTEM OF CHAIR AND CHAIR HAVING THE SAME

CROSS-REFERENCE TO RELATED APPLICATIONS

This application claims the priority of Korean Patent Application No. 10-2021-0180311 filed on Dec. 16, 2022, in the Korean Intellectual Property Office, the disclosure of which is incorporated herein by reference.

BACKGROUND

Field

The present disclosure relates to a lumbar supporting system of a chair and a chair having the same, and more particularly, to a lumbar supporting system of a chair and a chair having the same, which are capable of enabling a user to adjust a position of a lumbar pad according to a body type of the seated user by freely adjusting the position of the lumbar pad in an upward/downward direction (height adjustment) and a forward/rearward direction (depth adjustment) by performing a simple manipulation even in a state in which the user is seated on the chair.

Description of the Related Art

In general, a chair includes: a seat configured to support a user's buttocks; legs installed on a bottom surface of the seat; a backrest installed rearward of the seat and configured to support the user's waist (lumbar vertebrae) and back; a support configured to support the backrest; armrests installed at two opposite sides of the seat and configured to support the user's arms; and a head support installed on an upper portion of the backrest and configured to support the user's head. The backrest is made of a material such as plastic or fabric having flexibility or elasticity. The backrest is typically installed rearward of the seat and configured to be resiliently bendable by a predetermined angle so as to support the user's back when the user is seated in the seat.

In modern society, office workers, who are working in the office, and students, who are studying at their desks, are seated in chairs over a long period of time. However, because the backrest of the chair in the related art cannot structurally support the user's waist comfortably and gently, there is a problem in that comfort deteriorates and backache such as back pain is caused.

That is, in case that the backrest is bent by the seated user, a space is formed between the backrest and a waist portion of the user's back, and the waist portion cannot be supported at all. For this reason, the seated user, who is working or studying while being seated on the chair over a long period of time, suffers from increased fatigue on the waist portion.

In the related art, the user purchases a separate sitting mat or a cushion to prevent back pain and then sits on the chair with the sitting mat or the small cushion on the waist to support the waist. However, because the sitting mat or the cushion is not fixed to the chair without being maintained at a predetermined angle, which causes a problem in that the user's waist cannot be appropriately supported when the user moves.

Of course, various waist supports have been developed to solve the above-mentioned problems. However, most of the waist supports have complicated configurations, or the entire structure of the chair needs to be changed, which affects the entire production line and causes a problem of an increase in economic burden.

In addition, because the waist support in the related art is made of a material having flexibility in order to increase a close-contact force applied to the user's waist portion, the waist support is bent when the user moves. For this reason, the waist support cannot accurately support the user's waist.

In addition, the waist support in the related art may be adjusted in height (moved in an upward/downward direction) according to the condition of the user's body, but the waist support cannot be adjusted in depth (moved in a forward/rearward direction of the chair). For this reason, there is a problem in that the waist support cannot come into close contact with the user's waist and support the user's waist.

In addition, a lumbar supporting system capable of adjusting the height and depth of the waist support has been developed to solve the above-mentioned problems. However, the developed lumbar supporting system is configured to be manipulated by two hands or configured as a dial type (rotary) lumbar supporting system, which makes it difficult for the user to adjust the height and depth of the waist support in a state in which the user is seated on the chair. For this reason, the user needs to move to a location behind the chair, adjust the height and depth of the waist support without sitting on the chair, and then sit on the chair, which causes several problems in that the user cannot accurately adjust the position of the waist support so that the waist support corresponds to the waist of the seated user.

DOCUMENTS OF RELATED ART

Patent Documents (Patent Document 1) Korean Patent No. 10-1384987 (Apr. 8, 2014)

(Patent Document 2) Korean Utility Model Registration No. 20-0436742 (Sep. 19, 2007)

(Patent Document 3) Korean Patent Application Laid-Open No. 10-2011-0043307 (Apr. 27, 2011)

(Patent Document 4) Korean Patent Application Laid-Open No. 10-2010-0107288 (Oct. 5, 2010)

SUMMARY

An object to be achieved by the present disclosure is to provide a lumbar supporting system of a chair and a chair having the same, which are capable of accurately supporting a user's waist according to the user's body type by adjusting a height and depth of a lumbar pad by using a vertical operating force.

Another object to be achieved by the present disclosure is to provide a lumbar supporting system of a chair and a chair having the same, which are capable of enabling a user to adjust a height and depth of a lumbar pad in a state in which the user is seated on the chair.

A lumbar supporting system of a chair according to the present disclosure includes: a lumbar frame having two opposite ends fixedly installed on a backrest frame of a chair; a depth adjuster including a guide cover fixedly installed on the lumbar frame, and a horizontal movable member installed to be inserted into the guide cover so as to slide in forward/rearward directions Y and Y'; an depth adjustment lever including an accommodation hole configured to accommodate the depth adjuster, and multi-stage support rails provided at two opposite ends of the accommodation hole and configured to be in contact with and supported by one side of the lumbar frame and to move in upward/downward directions Z and Z', the multi-stage support rails being configured such that operating pins fixedly installed at two opposite sides of the horizontal movable member are in contact with and supported by the multi-stage support rails; a pad support part including vertical waveform rails configured to be in elastic contact with elastic pieces provided on the horizontal movable member of the depth adjuster, the pad support part being connected to and installed on the horizontal movable member and configured to be slidable in the upward/downward directions Z and Z'; and a lumbar pad fitted with and coupled to two opposite ends of the pad support part and configured to come into elastic contact with a waist of a seated user, in which the horizontal movable member is horizontally moved in the forward/rearward directions Y and Y' by the movement of the depth adjustment lever in the upward/downward directions Z and Z', such that a depth of the lumbar pad in the forward/rearward direction is adjusted, and in which a height of the lumbar pad is adjusted by the movement of the pad support part in the upward/downward directions Z and Z' based on the horizontal movable member.

According to the present disclosure, the height is adjusted as the lumbar pad is moved in the upward/downward direction by the upward/downward vertical operating force, and the depth is adjusted as the lumbar pad is moved in the forward/rearward direction, which makes it possible to easily adjust the height and depth of the lumbar pad even with a small effort.

According to the present disclosure, the height and depth of the lumbar pad are adjusted by the upward/downward vertical operating force, which makes it possible to easily adjust the position of the lumbar pad even in the state in which the user is seated on the chair.

According to the present disclosure, the height and depth of the lumbar pad for supporting the waist of the seated user are adjusted, the waist may be stably supported to be suitable for the body condition of the seated user, and the waist of the seated user may be more comfortably supported, which may help the waist health of the seated user.

According to the present disclosure, the lumbar pad is made of a soft material that provides a predetermined elastic force, such that the lumbar pad comes into contact with the waist of the seated user while surrounding the waist of the seated user when the load occurs, which makes it possible to improve the supporting force for supporting the waist of the seated user.

According to the present disclosure, the depth adjustment lever slides in the upward/downward direction while coming into contact with the plurality of vertical ribs, the guiders, and the guide protrusions provided on the lumbar frame. Therefore, no clearance occurs when the depth adjustment lever operates, the operability in the upward/downward direction is improved, and the depth of the lumbar pad is smoothly adjusted.

According to the present disclosure, when the lumbar pad moves in the forward/rearward direction, the horizontal movable member of the depth adjuster connected to the lumbar pad moves horizontally along the horizontal slide hole of the guide cover. Therefore, no clearance occurs when the horizontal movable member is operated in the forward/rearward direction by the depth adjustment lever, which may provide lots of effects such as the smooth adjustment of the depth of the lumbar pad.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
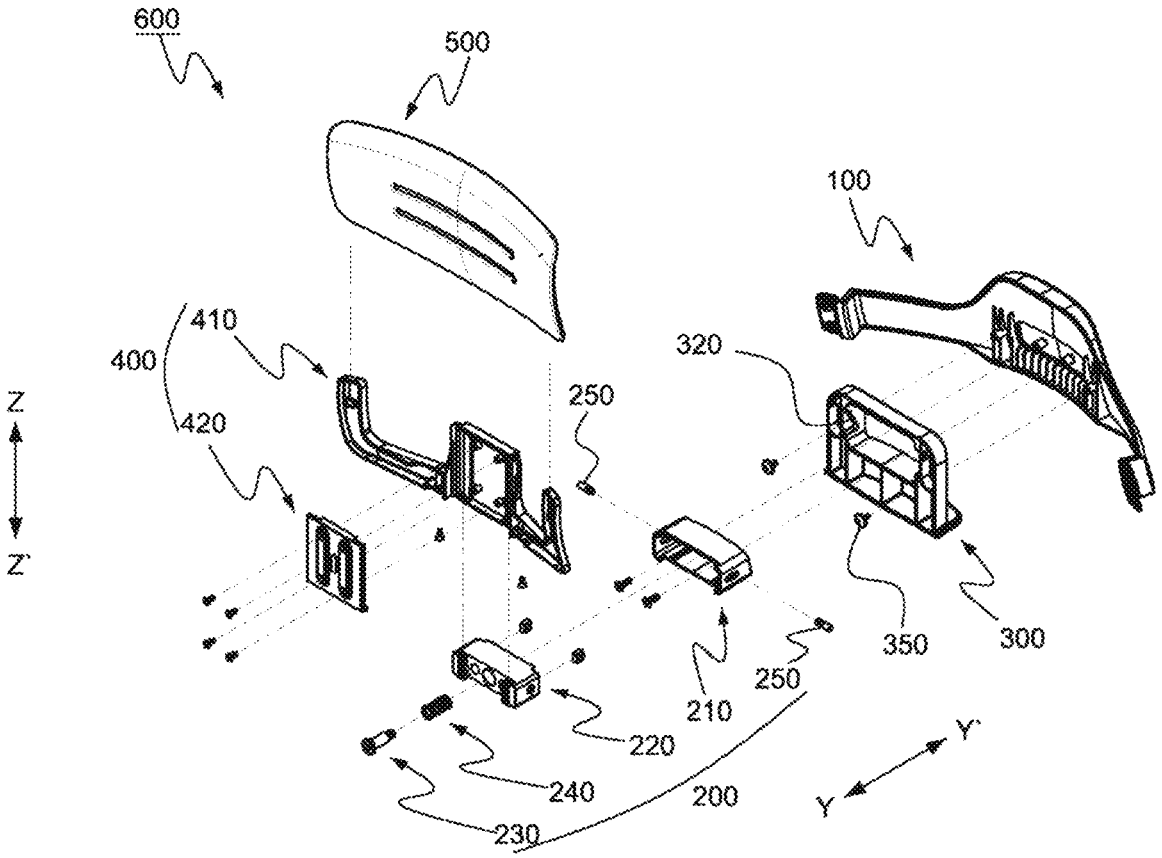
FIG. 1 is an exemplified view illustrating a configuration according to the present disclosure.
Figure 2:
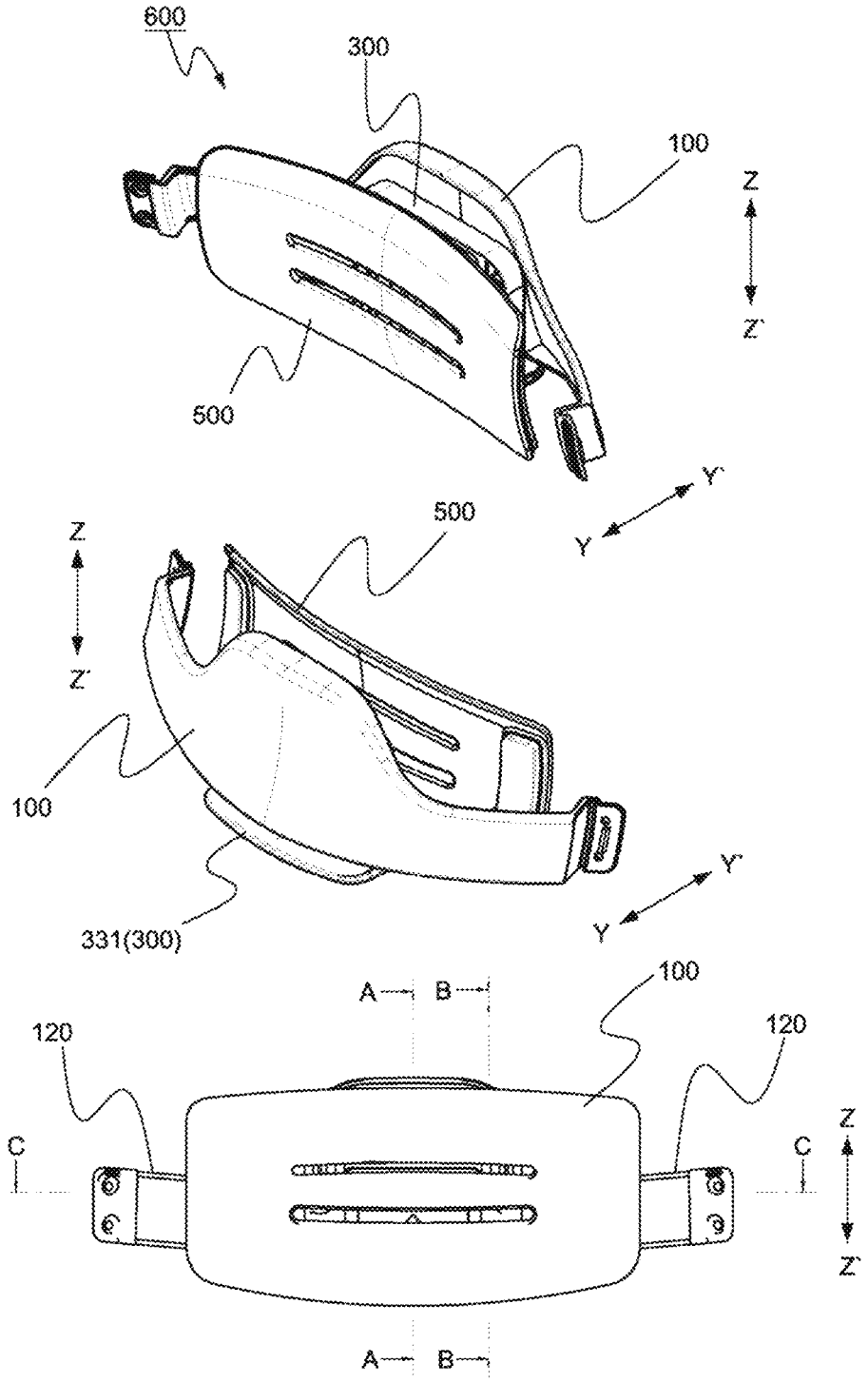
FIG. 2 is an exemplified view illustrating an assembled configuration according to the present disclosure.
Figure 3:
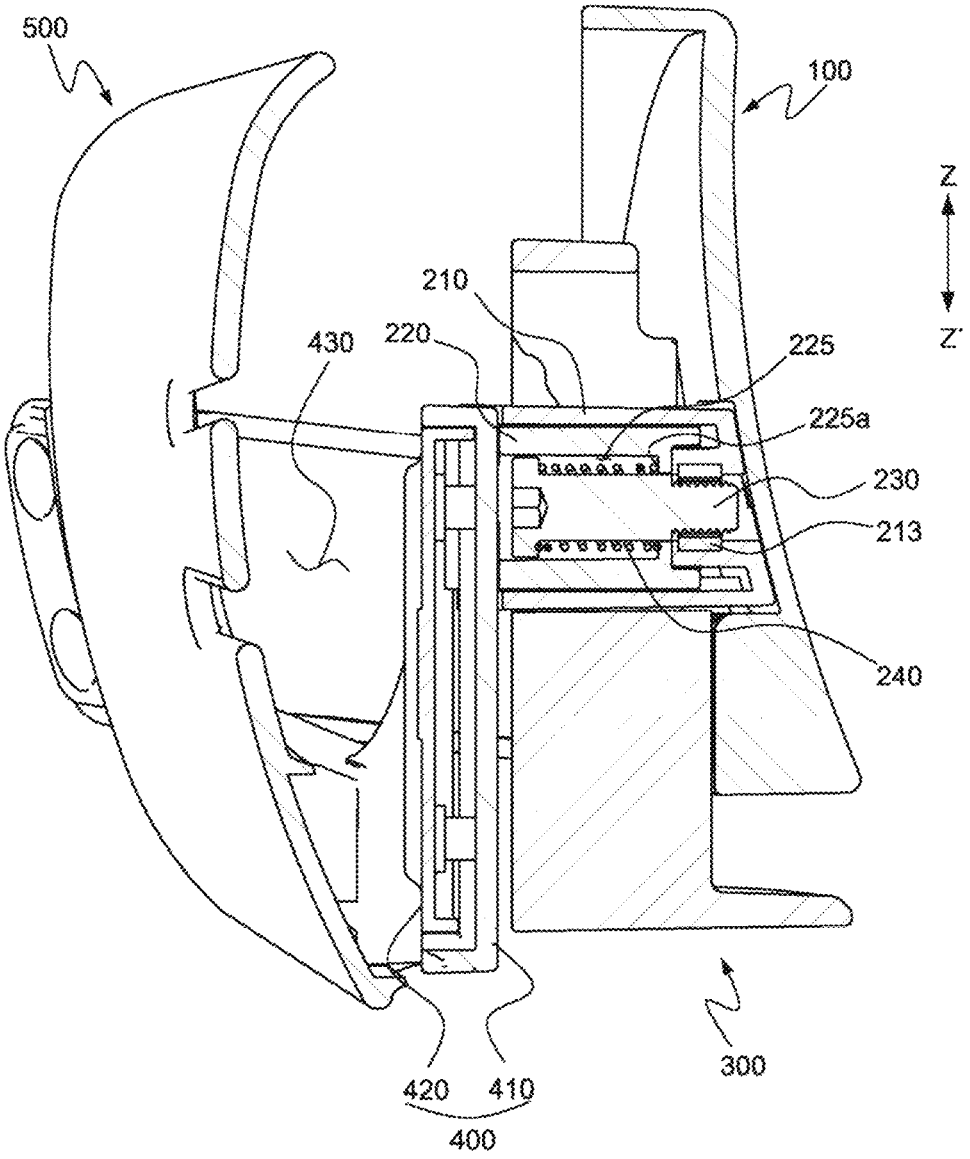
FIG. 3 is an exemplified view illustrating a cross-sectional configuration taken along line A-A in FIG. 2.
Figure 4:
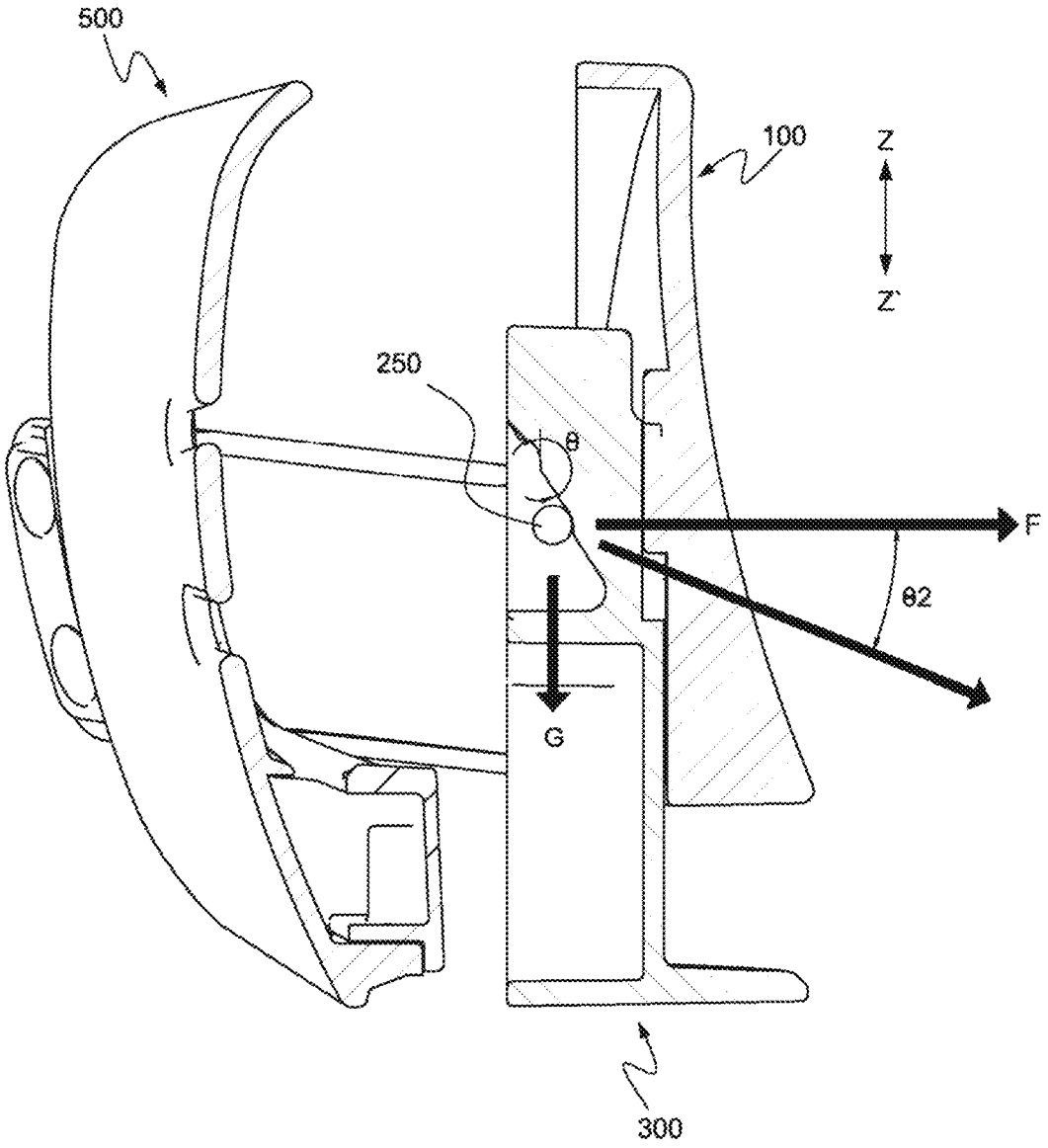
FIG. 4 is an exemplified view illustrating a cross-sectional configuration taken along line B-B in FIG. 2.
Figure 5:
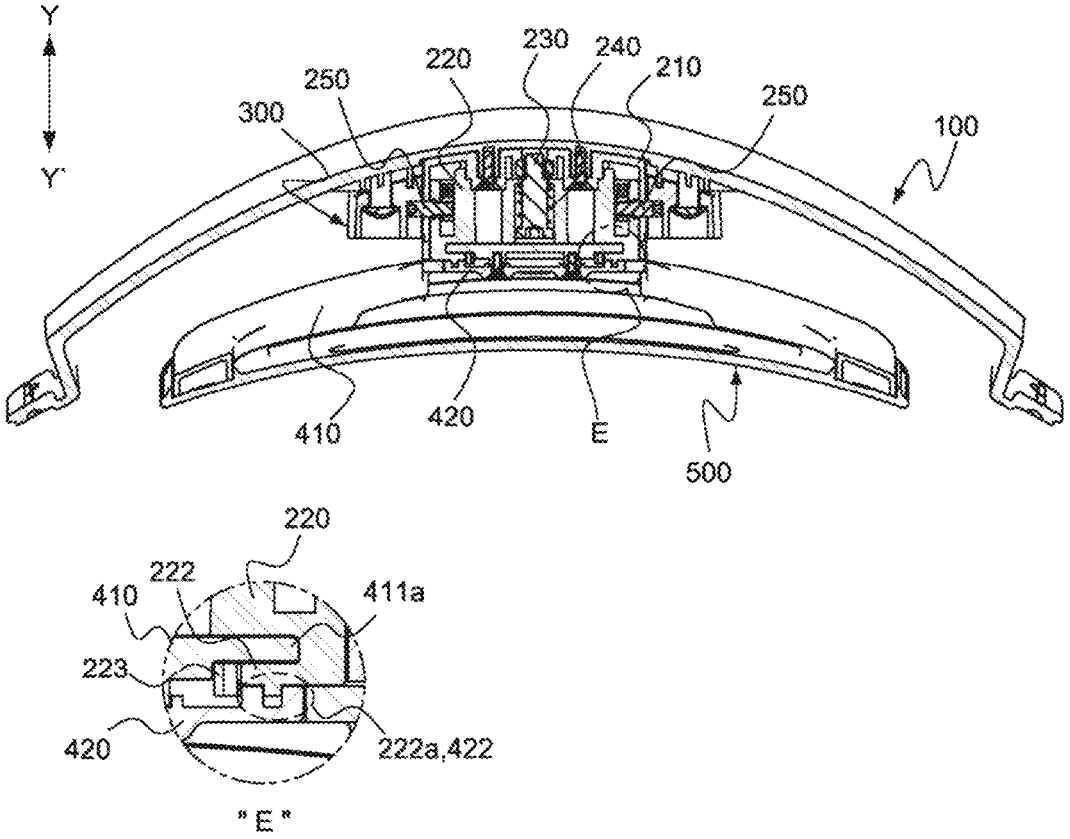
FIG. 5 is an exemplified view illustrating a cross-sectional configuration taken along line C-C in FIG. 2.
Figure 6:
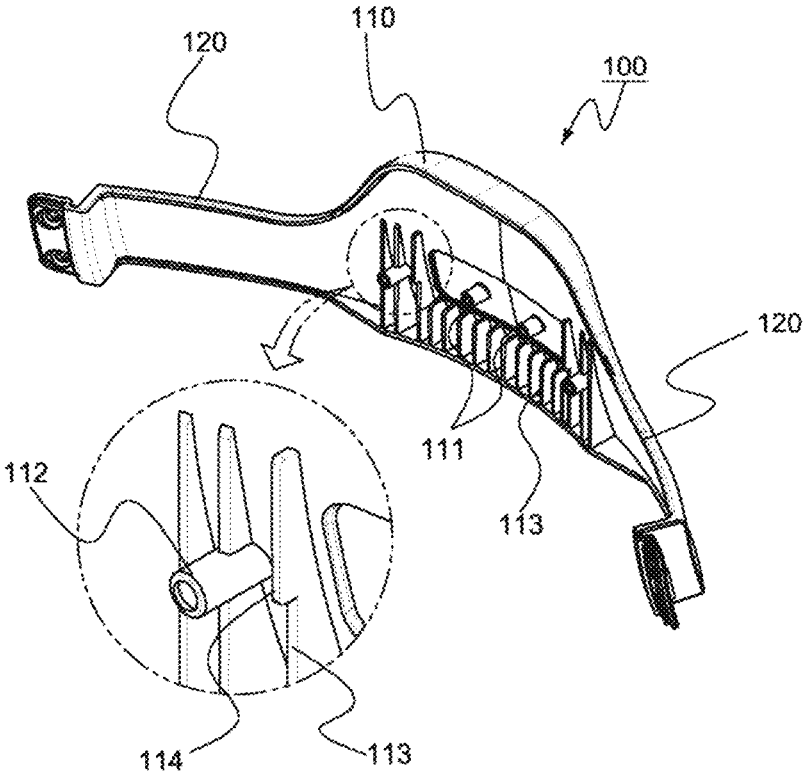
FIG. 6 is an exemplified view illustrating a configuration of a lumbar frame according to the present disclosure.
Figure 7A:
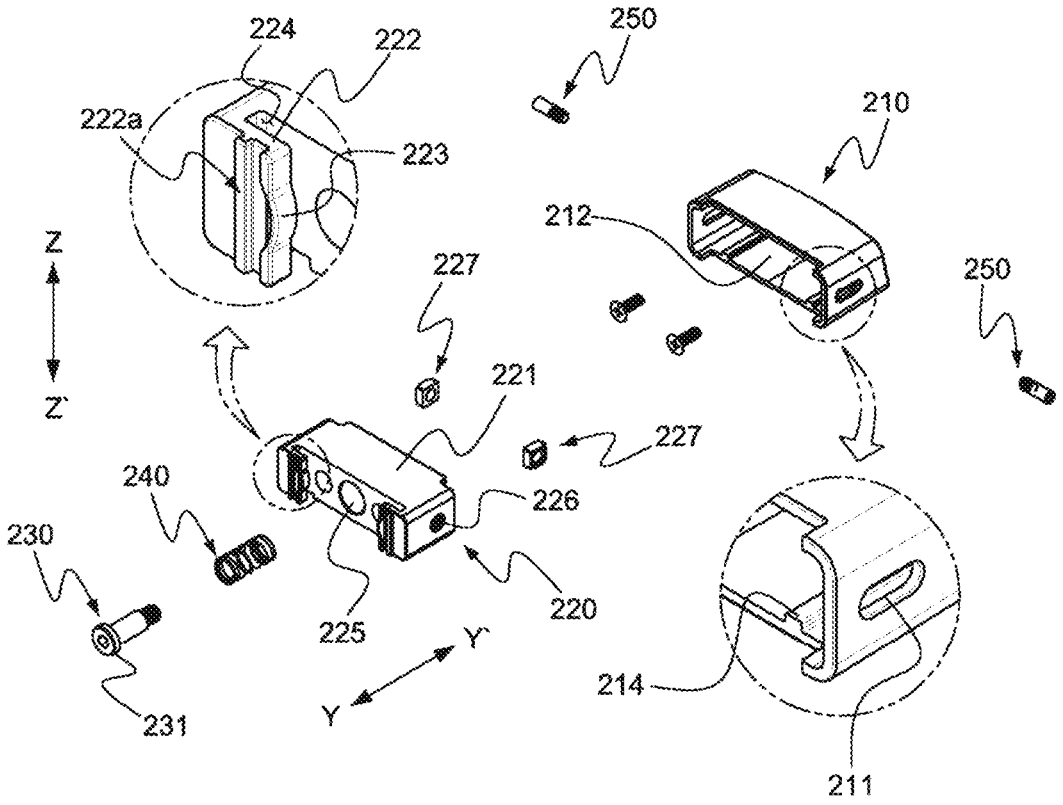
FIG. 7A is an exemplified view illustrating a configuration of a depth adjuster according to the present disclosure.
Figure 7B:
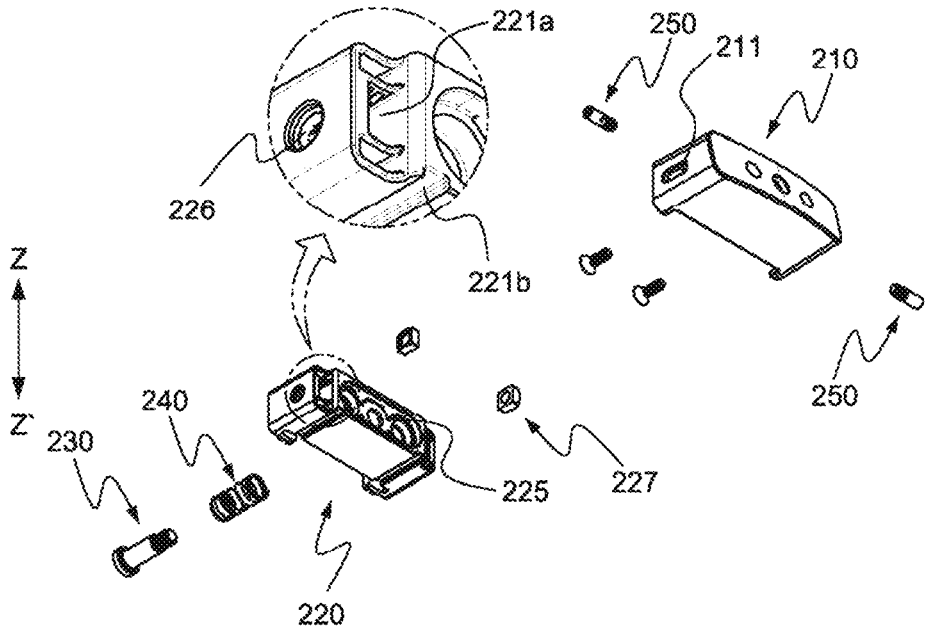
FIG. 7B is another exemplified view illustrating a configuration of the depth adjuster according to the present disclosure.
Figure 8A:
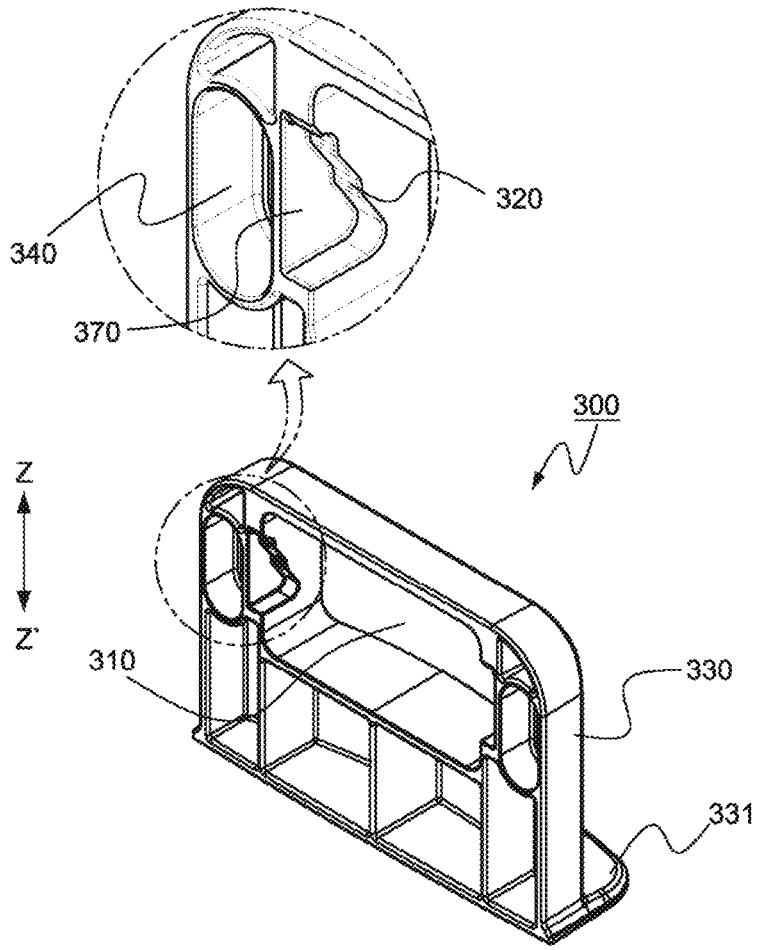
FIG. 8A is an exemplified view illustrating a configuration of a depth adjustment lever according to the present disclosure.
Figure 8B:
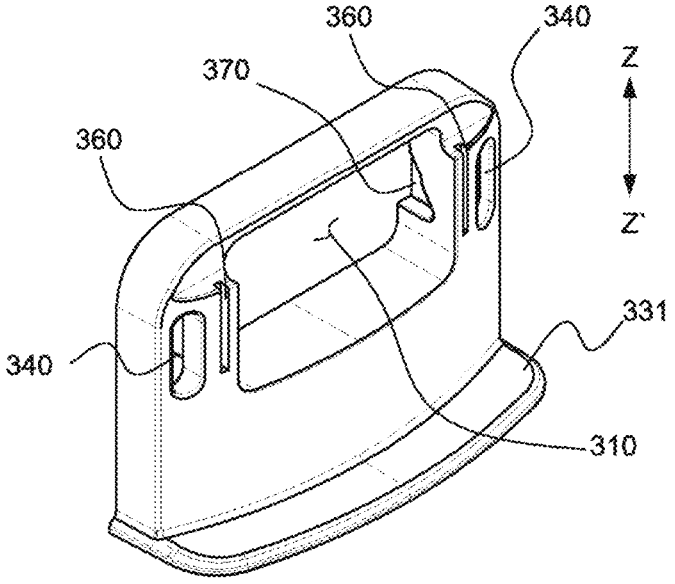
FIG. 8B is another exemplified view illustrating a configuration of the depth adjustment lever according to the present disclosure.
Figure 9A:
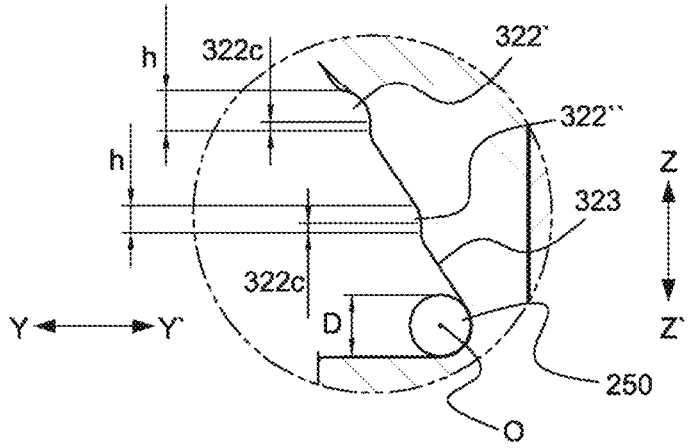
FIGS. 9A, 9B, 9C, and 9D are exemplified views illustrating a configuration of a multi-stage support rail according to the present disclosure.
Figure 9B:
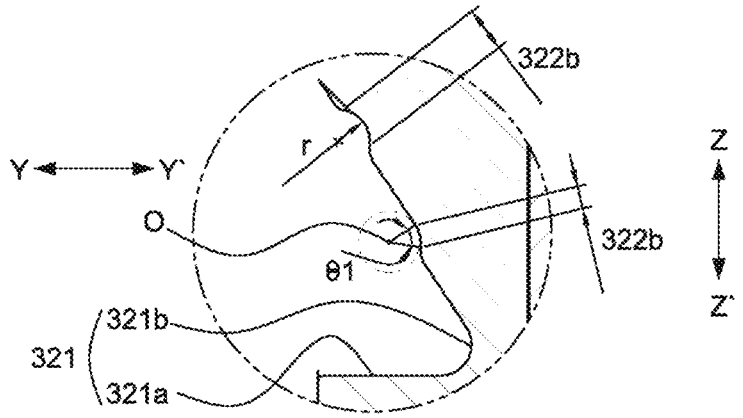
Figure 9C:
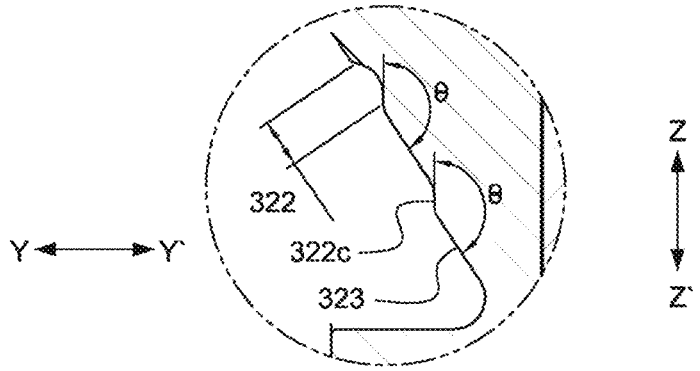
Figure 9D:
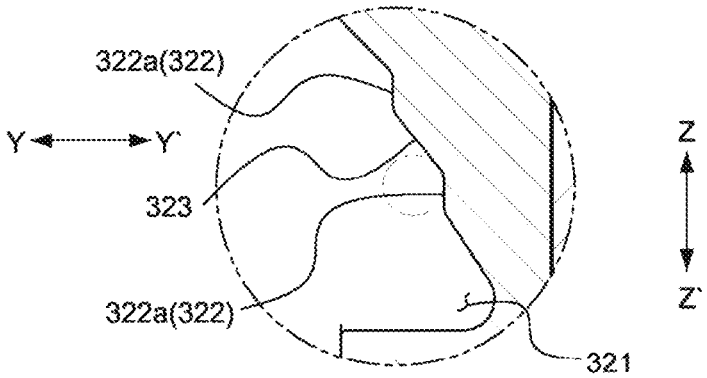
Figure 10:
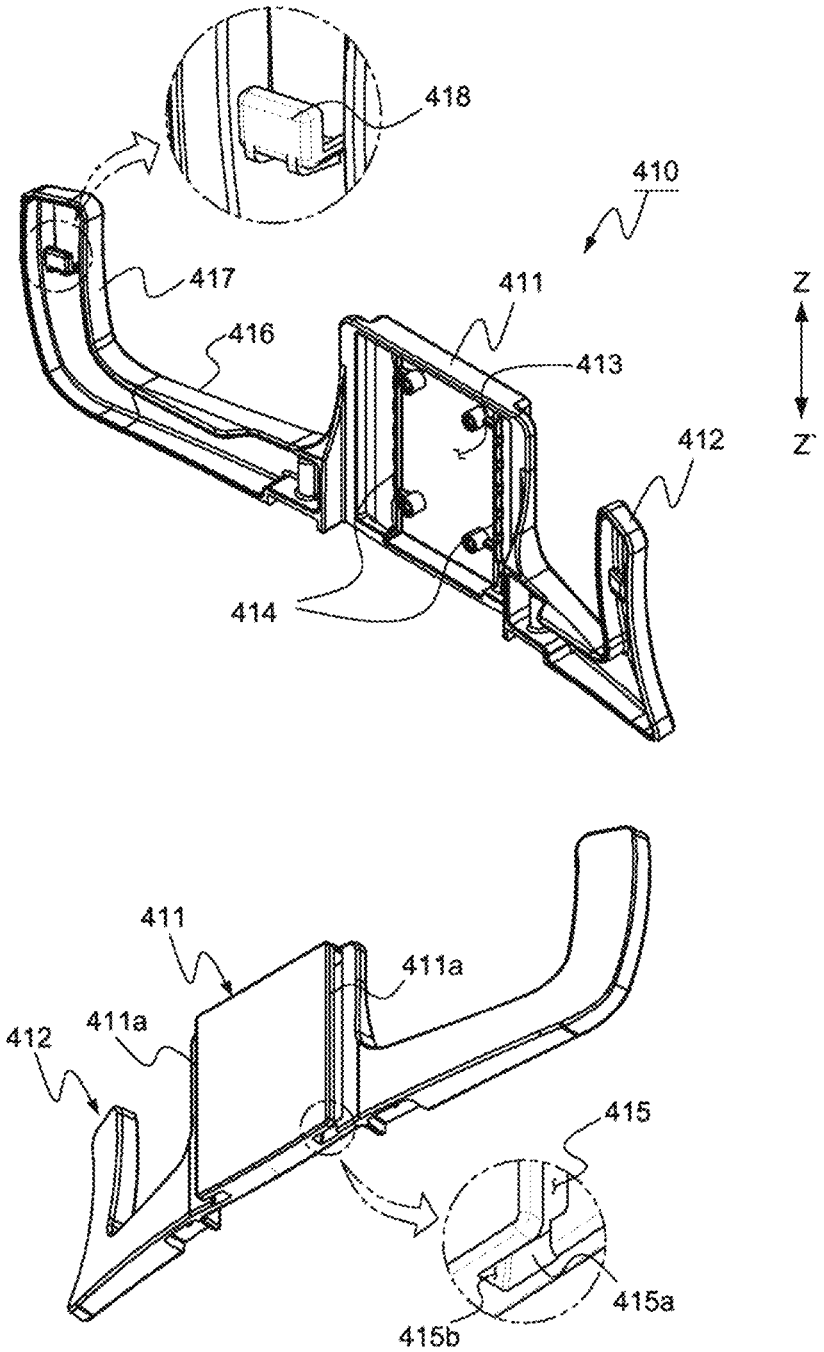
FIG. 10 is an exemplified view illustrating a configuration of a lumbar bracket according to the present disclosure.
Figure 11:
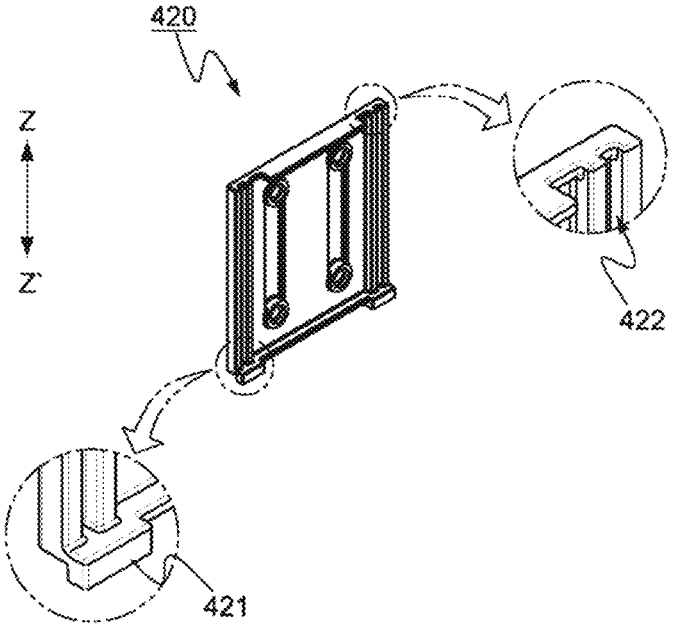
FIG. 11 is an exemplified view illustrating a configuration of a lumbar plate according to the present disclosure.
Figure 12:
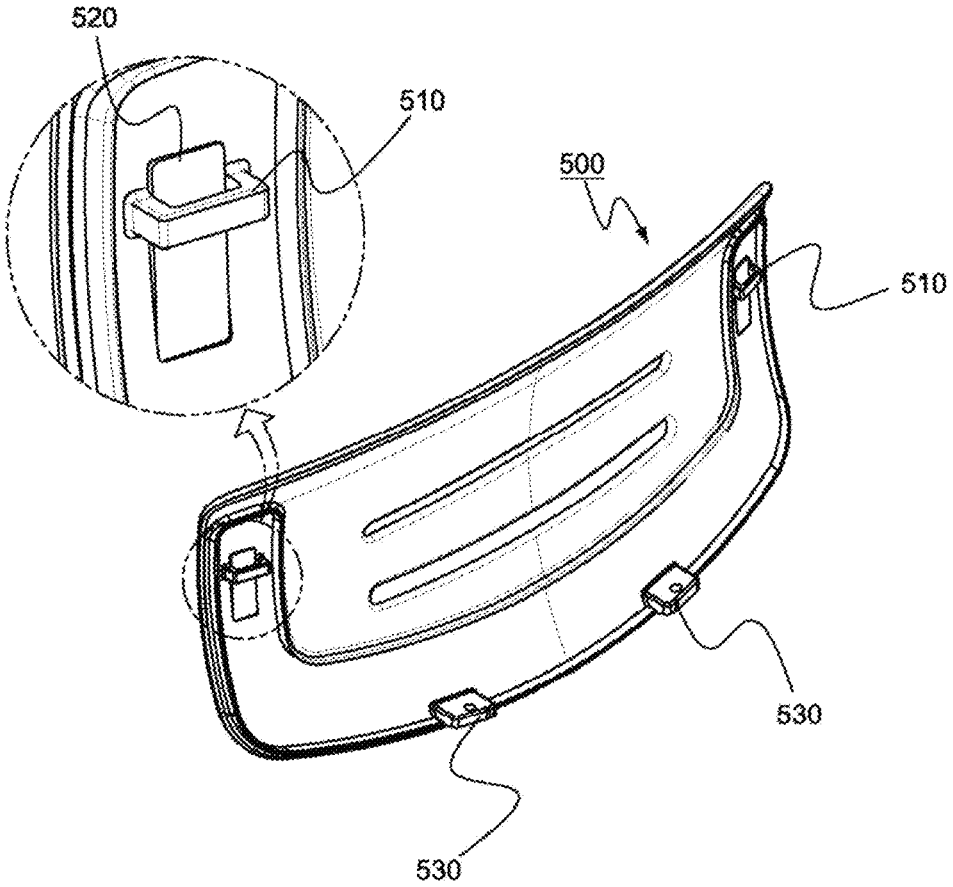
FIG. 12 is an exemplified view illustrating a configuration of a lumbar pad according to the present disclosure.
Figure 15:
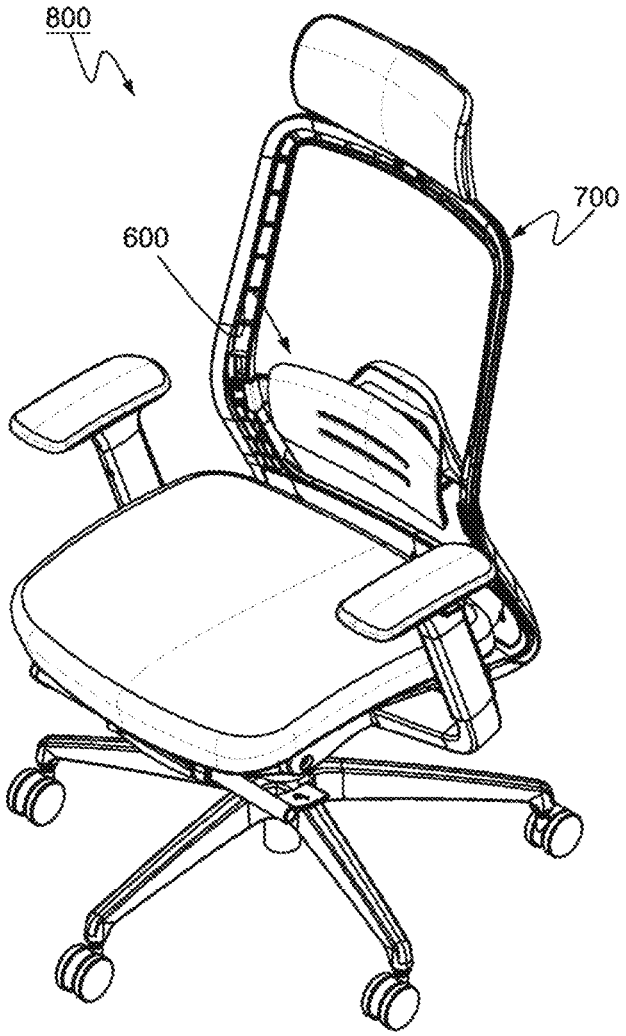
FIG. 15 is an exemplified view illustrating a configuration of a chair according to the present disclosure.

FIG. 1 is an exemplified view illustrating a configuration according to the present disclosure, FIG. 2 is an exemplified view illustrating an assembled configuration according to the present disclosure, FIG. 3 is an exemplified view illustrating a cross-sectional configuration taken along line A-A in FIG. 2, FIG. 4 is an exemplified view illustrating a cross-sectional configuration taken along line B-B in FIG. 2, FIG. 5 is an exemplified view illustrating a cross-sectional configuration taken along line C-C in FIG. 2, FIG. 6 is an exemplified view illustrating a configuration of a lumbar frame according to the present disclosure, FIGS. 7A and 7B are exemplified views illustrating a configuration of a depth adjuster according to the present disclosure, FIGS. 8A and 8B are exemplified views illustrating a configuration of a depth adjustment lever according to the present disclosure, FIGS. 9A, 9B, 9C, and 9D are exemplified views illustrating a configuration of a multi-stage support rail according to the present disclosure, FIG. 10 is an exemplified view illustrating a configuration of a lumbar bracket according to the present disclosure, FIG. 11 is an exemplified view illustrating a configuration of a lumbar plate according to the present disclosure, FIG. 12 is an exemplified view illustrating a configuration of a lumbar pad according to the present disclosure, and FIG. 15 is an exemplified view illustrating a configuration of a chair according to the present disclosure. The present disclosure is connected to and installed on a backrest frame of a chair and configured to easily adjust a height and depth of the lumbar pad by using a vertical operating force.

That is, the present disclosure includes: a lumbar frame 100 having two opposite ends fixedly installed on a backrest frame 700 of a chair 800; a depth adjuster 200 including a guide cover 210 fixedly installed on the lumbar frame 100, and a horizontal movable member 220 installed to be inserted into the guide cover 210 so as to slide in forward/rearward directions Y and Y'; an depth adjustment lever 300 including an accommodation hole 310 configured to accommodate the depth adjuster 200, and multi-stage support rails 320 provided at two opposite ends of the accommodation hole and configured to be in contact with and supported by one side of the lumbar frame 100 and to move in upward/downward directions Z and Z', the multi-stage support rails 320 being configured such that operating pins 250 fixedly installed at two opposite sides of the horizontal movable member 220 are in contact with and supported by the multi-stage support rails 320; a pad support part 400 connected to and installed on the horizontal movable member 220 of the depth adjuster and configured to be slidable in the upward/downward directions Z and Z'; and a lumbar pad 500 fitted with and coupled to two opposite ends of the pad support part 400 and configured to come into elastic contact with a waist of a seated user. The horizontal movable member 220 is horizontally moved in the forward/rearward directions Y and Y' by the movement of the depth adjustment lever 300 in the upward/downward directions Z and Z', such that a depth of the lumbar pad 500 in the forward/rearward direction is adjusted. Further, a height of the lumbar pad 500 is adjusted by the movement of the pad support part 400 in the upward/downward directions Z and Z' based on the horizontal movable member 220.

As illustrated in FIGS. 1 to 6, the lumbar frame 100 includes: a center frame 110 to which the guide cover 210 of the depth adjuster 200 is screw-fastened and integrally fixed; and blade frames 120 integrated with two opposite sides of the center frame 110 and each having an end fixedly installed on the backrest frame 800 of the chair.

The center frame 110 includes: cover fasteners 111 to which the guide cover 210 of the depth adjuster is screw-fastened; guiders 112 protruding to be symmetric with respect to the cover fasteners 111 and configured to prevent withdrawal of the depth adjustment lever 300 while guiding the movement of the depth adjustment lever 300 in the upward/downward directions Z and Z'; and a plurality of vertical ribs 113 protruding to be in contact with and supported by one surface of the depth adjustment lever 300.

That is, the lumbar frame 100 has the blade frames 120 provided at the two opposite sides of the center frame 110 and integrated with the center frame 110 while having a predetermined length. The cover fasteners 111, the pair of guiders 112, and the plurality of vertical ribs 113 protrude from one surface of the center frame 110, i.e., one surface directed toward the depth adjustment lever 300.

In addition, the center frame 110 and the blade frames 120 may be connected such that the lumbar frame 100 has a predetermined curvature according to a shape of the backrest frame 700.

As illustrated in FIGS. 1 to 3, 5, 7A, and 7B, the depth adjuster 200 includes: the guide cover 210 fixedly installed on the lumbar frame 100; the horizontal movable member 220 installed to be inserted into the guide cover 210 and configured to be movable horizontally in the forward/rearward directions Y and Y'; a limit bolt 230 configured to penetrate the horizontal movable member 220 and having an end fixedly installed on the guide cover 210; an elastic body 240 installed in the horizontal movable member 220 and having one side configured to be in contact with and supported by a bolt head 231 of the limit bolt, and the other side configured to be in contact with and supported by one side of the horizontal movable member 220; and the operating pins 250 fastened to two opposite surfaces of the horizontal movable member 220 while penetrating side long holes 211 formed in two opposite surfaces of the guide cover 210.

The guide cover 210 has a horizontal slide hole 212 into which the horizontal movable member 220 is inserted to be horizontally movable in the forward/rearward directions Y and Y'. The side long holes 211 are formed through the two opposite surfaces of the guide cover 210 and communicate with the horizontal slide hole 212. In this case, the horizontal slide hole 212 is structured to be opened at one side in the direction of the lumbar pad 500, such that the horizontal movable member 220 inserted into the horizontal slide hole 212 moves horizontally in the forward/rearward directions Y and Y'.

The horizontal movable member 220 includes: a main body 221 slidably inserted into the horizontal slide hole 212 of the guide cover 210; a pair of insertion protrusions 222 protruding from two opposite sides of one surface of the main body while facing each other so as to define guide grooves 224 into which one side of the pad support part 400 is inserted; elastic pieces 223 integrated with ends of the insertion protrusions 221 facing each other and provided to be in elastic contact with one side of the pad support part 400.

The main body 221 has a support hole 225 into which the limit bolt 230 and the elastic body 240 are inserted. Fastening holes 226 to which the operating pins 230 are fastened are formed in two opposite surfaces of the main body 221 and each have a predetermined depth. In addition, the support hole 225 is formed through the main body 221 so that a stepped portion **225*a* is provided to support the elastic body 240**.

The insertion protrusions 222 are inserted into one side of the pad support part 400 and serve to prevent the horizontal movable member 220 and the pad support part 400 from being separated in the forward/rearward directions Y and Y' and guide the pad support part 400 so that the pad support part 400 moves in the upward/downward directions Z and Z' based on the horizontal movable member 220.

That is, the insertion protrusions 222 protrude in a '[]' shape from the main body 221 so that the insertion protrusions 222 are symmetric with respect to the main body 221 of the horizontal movable member and define the guide grooves 224 between the insertion protrusions 222 and the main body 221.

In addition, the insertion protrusions 222 may each further include a concave-convex guide 222*a* formed in the upward/downward directions Z and Z' in one surface directed toward the lumbar pad 500. The concave-convex guides 222*a* are fitted and inserted into one side of the pad support part 400 so as to be slidable in the upward/downward directions Z and Z', such that the concave-convex guides 222*a* serve to allow the pad support part 400 to more stably slide in the upward/downward directions Z and Z' without causing a clearance at the time of adjusting the height of the lumbar pad 500.

In this case, the concave-convex guide 222*a* has concave and convex portions formed continuously. The convex portion is formed at an end facing the insertion protrusion 222.

The elastic piece 223 is in elastic contact with a vertical waveform rail 414 of the pad support part 400 and serves to fix a height position of the lumbar pad 500 and minimize a contact area between the horizontal movable member 220 and the pad support part 400, thereby allowing the pad support part 400 to smoothly move in the upward/downward directions Z and Z'.

In addition, in case that the concave-convex guides 222*a* are further provided in the insertion protrusions 222, the elastic pieces 223 may be integrated with the convex portions positioned at the ends of the concave-convex guides 222*a*, i.e., the convex portions facing each other, such that the elastic pieces 223 may be elastically deformed in the direction of the concave portion.

In case that the elastic pieces 223 and the concave-convex guides 222*a* are provided on the insertion protrusions 222 as described above, the vertical waveform rails 414 of the pad support part 400 are elastically supported by the elastic pieces 223 of the insertion protrusions, and vertical guides 422 of the pad support part 400 are inserted into the concave-convex guides 222*a* of the insertion protrusions and slide. Therefore, the pad support part 400 more smoothly move in the upward/downward directions Z and Z' without a clearance.

The guide groove 224 is a space formed between the insertion protrusion 222 and the main body 221 by the insertion protrusion 222 protruding while being spaced apart from the main body 221. One side of the pad support part 400 is inserted into the guide grooves 224 so as to be slidable in the upward/downward directions Z and Z', such that the guide grooves 224 serve to guide the pad support part 400 in the upward/downward directions Z and Z' at the time of adjusting the height of the lumbar pad 500.

The limit bolt 230 serves to allow the elastic body 240 to elastically support the horizontal movable member 220 and is fastened to and installed on the guide cover 210 through the support hole 225 of the main body. In this case, the limit bolt 230 may be fastened directly to the guide cover 210 or fastened to a nut 213 made of a metallic material and integrally inserted into the guide cover 210.

In addition, when the limit bolt 230 is fastened to the guide cover 210, the bolt head 231 is positioned in the support hole 225.

One side of the elastic body 240 is in contact with and supported by the limit bolt 230, and the other side of the elastic body 240 is in contact with and supported by one side of the horizontal movable member 220, such that an elastic force is applied so that the horizontal movable member 220 is moved in the horizontal slide hole 212 of the guide cover in the direction of the lumbar frame 100 by the elastic force.

That is, the elastic body 240 is installed in the support hole 225 so that one side of the elastic body 240 is in contact with and supported by the bolt head 231 of the limit bolt, and the other side of the elastic body 240 is in contact with and supported by the stepped portion 225*a* provided in the support hole 225 of the horizontal movable member 220. For example, a compression spring may be installed as the elastic body 240.

The operating pins 250 serve to support a load of the seated user when the load is transmitted to the depth adjuster 200 through the lumbar pad 500 and the pad support part 400. The operating pins 250 are fastened to the fastening holes 226 of the horizontal movable member 220 through the side long holes 211 of the guide cover 210 so as to protrude to the outside of the guide cover 210.

That is, one side of each of the operating pins 250 protruding from the two opposite sides of the guide cover 210 is in contact with and supported by one side of the multi-stage support rail 320 of the depth adjustment lever 300 and supports a load (F, a force applied by the seated user, i.e., an elastic force of the elastic body) transmitted in the rearward direction Y' through the lumbar pad 500. In this case, the operating pin 250 is made of a metallic material. For example, a non-head bolt may be used as the operating pin 250.

In addition, the operating pins 250 may provide sufficient rigidity by being fastened to the fastening holes 226 formed in the main body of the horizontal movable member. However, fastening nuts 227 may be installed to be inserted into the main body 221 so as to communicate with the fastening holes 226, and then the operating pins 250 may be simultaneously fastened to the fastening holes 226 and the fastening nuts 227 or fastened to the fastening nuts 227 while penetrating the fastening holes 226. In case that the fastening nuts 227 are further provided as described above, the fastening force applied by the operating pins 250 is further increased, and the supporting force for supporting the load of the seated user is further improved.

In addition, the main body 221 of the horizontal movable member may further have nut insertion holes 221*a* into which the fastening nuts 227 are inserted and installed. In this case, the nut insertion holes 221*a* are formed so that the fastening nuts 227 are fixed without a separate fixing means, i.e., the fastening nuts 227 are fixed by being press-fitted into the nut insertion holes 221*a*. The nut insertion holes 221*a* are formed in the main body 221 and communicate with the fastening holes 226.

In addition, the operating pins 250 are fastened to the horizontal movable member 220 while penetrating the side long holes 211 of the guide cover 210. Therefore, the operating pins 250 serve to prevent the guide cover 210 and the horizontal movable member 220 from being separated and serve to restrict a movement range of the horizontal movable member 220 in the forward/rearward directions Y and Y' in the accommodation hole of the guide cover 210.

In addition, in the depth adjuster 200 configured as described above, horizontal guides 214 protrude in the horizontal slide hole 212 of the guide cover 21, and the main body 221 of the horizontal movable member has slide grooves 221*b* corresponding to the horizontal guides 214. When the horizontal movable member 220 slides in the forward/rearward directions Y and Y' in the horizontal slide hole 212 of the guide cover, the horizontal movable member 220 moves along the horizontal guides 214 of the guide cover 21, thereby improving operability in the forward/rearward directions Y and Y'.

The depth adjustment lever 300 operates in the upward/downward directions Z and Z' and adjusts a depth position of the lumbar pad 500 by horizontally moving the lumbar pad 500 in the forward/rearward directions Y and Y'. As illustrated in FIGS. 1 to 5, 8A, and 8B, the depth adjustment lever 300 includes: a lever main body 330 having a handle 331 formed at a lower end thereof; an accommodation hole 310 formed through the lever main body 330 and configured to accommodate the depth adjuster 200; the multi-stage support rails 320 formed on the lever main body 330 and positioned at the two opposite ends of the accommodation hole 310; and vertical guide holes 340 formed through the lever main body 330 so that the guiders 112 of the lumbar frame are inserted into the vertical guide holes 340.

The depth adjuster 200 is penetratively inserted into the accommodation hole 310. The accommodation hole 310 is formed through the lever main body 330 while having a predetermined size to prevent interference with the depth adjuster 200 when the lever main body 330 operates upward or downward.

The multi-stage support rails 320 are used to adjust the depth of the lumbar pad 500 in multiple stages and positioned in rail grooves 370 formed at two opposite sides of the accommodation hole 310 and configured to communicate with the accommodation hole 310. That is, the multi-stage support rail 320 is formed in the rail groove 370 opened at one side directed toward the lumbar pad 500 so that the operating pin 250 of the depth adjuster is in contact with and supported by the multi-stage support rail 320.

As illustrated in FIGS. 8A, 8B, 9A, 9B, 9C, and 9D, the multi-stage support rail 320 has a stepped structure having a lower catching projection 321 and a plurality of upper catching projections 322 connected by a downward inclined guide 323 along an inclined surface of the rail groove 370 having a right-angled triangular shape as a whole.

The multi-stage support rail 320 includes: the lower catching projection 321 configured such that the operating pin 250 of the depth adjuster is in contact with and supported by the lower catching projection 321, the lower catching projection 321 being configured to restrict the movement of the depth adjustment lever in the upward direction Z; the plurality of upper catching projections 322 positioned above the lower catching projection 321 and configured such that the operating pin 250 of the depth adjuster is in contact with and supported by the plurality of upper catching projections 322; and the downward inclined guide 323 configured to connect the lower catching projection 321, the upper catching projection 322, one side upper catching projection, and another upper catching projection adjacent to one side upper catching projection.

The lower catching projection 321 serves to support a load transmitted by the operating pin 250 in a state (first stage basic state) in which the lumbar pad 500 is maximally moved in the direction of the lumbar frame 100. The lower catching projection 321 includes: a stopper surface 321*a* provided to be in contact with and supported by the operating pin 250 and configured to restrict the movement of the depth adjustment lever in the upward direction Z; and a support surface 321*b* provided to be in contact with and supported by the operating pin 250 and configured to restrict the movement of the lumbar pad 500 in the rearward direction Y'. In this case, the stopper surface 321*a* is formed to allow the operating pin 250 to move horizontally, and the support surface 321*b* is formed to be in contact with and supported by the operating pin 250 while surrounding an outer surface of the operating pin 250.

The upper catching projection 322 has a predetermined area so that the operating pin 250 is in contact with and supported by the upper catching projection 322. One or more upper catching projections 322 are formed above the lower catching projection 321. In this case, the upper catching projections 322 are connected by the downward inclined guide 323 so that one side upper catching projection 322' positioned at the upper side is positioned to be directed toward the lumbar pad 500 direction, and another upper catching projection 322" positioned at the lower side is positioned to be directed toward the lumbar frame 100. The upper catching projection 322" positioned at the lowermost end is connected to the lower catching projection 321 by the downward inclined guide 323.

For example, the multi-stage support rail 320 may include: the plurality of upper catching projections 322 each having a height h of about 0.5 D to 1.0 D in respect to a diameter D of the operating pin 250; the downward inclined guide 323 formed to have a downward inclination angle θ of about 120° to 160° with respect to the upper catching projection 322; and the lower catching projection 321 having the same diameter as the operating pin 250 so that the operating pin 250 of the depth adjuster is seated and supported on the lower catching projection 321 in a state in which a periphery of an outer surface of the operating pin 250 of the depth adjuster is in surface contact with the lower catching projection 321.

The upper catching projection 322 includes a vertical flat surface in a predetermined section, and the vertical flat surface serves to support a load F (a load of a back portion of the seated user and an elastic force of the elastic body) applied in the direction of the lumbar frame 100 and prevent the depth adjustment lever 300 from being autonomously operated upward or downward by a load. In this case, the vertical flat surface means a flat surface orthogonal to a direction of the load F applied in the direction of the lumbar frame 100.

That is, as illustrated in FIG. 9D, the entire upper catching projection 322 may have only the vertical flat surface 322*a*. However, particularly, as illustrated in FIGS. 9A, 9B, and 9C, the upper catching projection 322 includes: a contact curved surface 322*b* with which the periphery of the outer surface of the operating pin 250 is in surface contact; and a vertical flat surface 322*c* extending from the contact curved surface 322*b*. The vertical flat surface 322*c* may be positioned below the contact curved surface 322*b*.

For example, the upper catching projection 322 includes the contact curved surface 322*b* and the vertical flat surface 322*c*. The contact curved surface 322*b* may have a curved surface length corresponding to a length of an arc having a central angle θ1 of 25° to 45° with respect to a center O of the operating pin when the operating pin 250 is in contact with and supported by the contact curved surface 322*b*. The vertical flat surface 322*c* is formed at a lower side of the contact curved surface 322*b* and integrally extends from the contact curved surface 322*b* while having a length of 0.1 D to 0.5 D in respect to the diameter D of the operating pin. An upper side of the contact curved surface 322*b* may be connected to the downward inclined guide 323, and a lower side of the vertical flat surface 322*c* may be connected to another downward inclined guide 323.

In case that the contact curved surface 322*b* has a length of an arc having a central angle θ1 less than 25° with respect to the center O of the operating pin, the function of the stepped portion deteriorates, and the operability of the depth adjustment lever 300 in the downward direction is improved. However, a contact area with the operating pin 250 decreases, which makes it difficult to stably support the load F.

In addition, in case that the contact curved surface 322*b* has a length of an arc having a central angle θ1 more than 45° with respect to the center O of the operating pin, the function of the stepped portion is improved, such that the load F may be stably supported. However, there is a problem in that a large amount of force is required to operate the depth adjustment lever in the downward direction Z', and the operability deteriorates.

In addition, in case that the vertical flat surface 322*c* has a length less than 0.1 D in respect to the diameter D of the operating pin, it is difficult to support the load F, which may cause a situation in which the operating pin 250 sways or moves along the multi-stage support rail 320 in the upward/downward directions Z and Z'.

In addition, in case that the vertical flat surface 322*c* has a length more than 0.5 D in respect to the diameter D of the operating pin, the load F may be stably supported. However, a friction surface with the operating pin 250 increases when the depth adjustment lever operates, which requires a large amount of force to adjust the depth adjustment lever 300 and degrades operability. Therefore, the length of the vertical flat surface 322*c* may be set within an appropriate range.

In case that the upper catching projection 322 includes the contact curved surface 322*b* and the vertical flat surface 322*c* as described above, the contact area between the operating pin 250 and the upper catching projection 322 increases, the supporting force for supporting the load F applied in the direction of the lumbar frame 100 further increases, and the operating pin is prevented from swaying in the upward/downward directions Z and Z'. Therefore, the height position of the lumbar pad 500 is smoothly fixed, and the depth adjustment lever 300 adjusts the height of the lumbar pad even with a small effort.

As illustrated in FIG. 4, the downward inclination angle θ of the downward inclined guide 323 may be set in consideration of a load operating angle θ2 according to a resultant force (F+G) of the load F (the load of the back of the seated user and the elastic force of the elastic body) and the gravity G based on the operating pin 250. That is, the downward inclination angle θ may be larger than the load operating angle θ2+90°.

In this case, the downward inclination angle θ means an angle of the downward inclined guide 323 with respect to the vertical flat surface 321*a* of the contact support surface 321 in the direction of the lumbar frame. The load operating angle θ2 means an angle (included angle) in the direction of the resultant force (F+G) with respect to the direction of the load F.

For example, in consideration of a configuration in which a load of the back of the seated user is 20 to 30 kgf and an elastic force applied by the elastic body is 1 to 2.5 kgf, the downward inclined guide 323 may be formed to have the downward inclination angle θ of about 120° to 160°, particularly, the downward inclination angle θ of about 130° to 150°, and more particularly, the downward inclination angle of about 145° to 150° with respect to the vertical flat surfaces 321*a* and 321*c* of the contact support surface 321 in the direction of the lumbar frame.

In case that the downward inclined guide 323 has a downward inclination angle more than 160°, a frictional force with the operating pin 250 increases when the depth adjustment lever moves in the upward/downward directions Z and Z', such that the operability of the depth adjustment lever 300 deteriorates, and a range in which the depth adjustment lever 300 adjusts the depth of the lumbar pad 500 by operating in the upward/downward direction decreases, which makes it difficult to efficiently adjust the depth of the lumbar pad 500.

In addition, in case that the downward inclined guide 323 has a downward inclination angle θ less than 120°, the operability of the depth adjustment lever 300 in the upward direction Z is excellent, but the operability in the downward direction Z' deteriorates. Further, a horizontal distance between the contact support surfaces 321 increases, and the length of the multi-stage support rail 320 in the forward/rearward direction increases (the thickness of the depth adjustment lever increases). Further, when the depth adjustment lever 300 moves stepwise in the upward/downward directions Z and Z', noise and impact occur because of the contact between the operating pin 250 and the contact support surface 321.

In case that the downward inclined guide 323 has a downward inclination angle θ less than 120°, the downward inclination angle θ is smaller than the load operating angle θ2+90°. Therefore, in case that a load is applied to the lumbar pad 500, the depth adjustment lever 300 may be operated in the upward direction Z by the load, and the lumbar pad may be pushed in the rearward direction Y'.

In addition, in the multi-stage support rail 320, connection portions between the upper catching projections 322 and the downward inclined guide 323, i.e., a connection portion between the contact curved surface 321*b* and the downward inclined guide 323 and a connection portion between the vertical flat surface 321*a* and the downward inclined guide 323 are rounded to facilitate the movement of the operating pin 250.

In addition, the drawings of the present disclosure illustrate the multi-stage support rail 320 having the lower catching projection 321, the two upper catching projections 322' and 322", and the three downward inclined guides 323. However, this is provided to assist in understanding the present disclosure, and the configuration of the multi-stage support rail is not limited thereto.

In addition, as illustrated in FIGS. 8A and 8B, the depth adjustment lever 300 further has guide slots 360 formed in one surface of the lever main body 330 directed toward the lumbar frame 100, i.e., one surface of the main body provided to be in contact with the vertical ribs 113 of the lumbar frame and configured to slide in the upward/downward directions Z and Z'. As illustrated in FIG. 6, guide protrusions 114 may further protrude from the lumbar frame 100, such that the guide slots 360 of the depth adjustment lever move along the guide protrusions 114 of the lumbar frame when the depth adjustment lever 300 slides in the upward/downward directions Z and Z'.

The guide slots 360 may be positioned between the accommodation hole 310 and the vertical guide holes 340 while having a predetermined length to prevent the withdrawal of the guide protrusions 114 when the depth adjustment lever moves in the upward/downward directions Z and Z'.

For example, the guide slot 360 has a shape opened in the upward direction Z. A lower portion of the guide protrusion 114 of the lumbar frame is positioned in the guide slot 360 when the depth adjustment lever 300 moves in the downward direction Z'. The guide protrusion 114 is positioned in the guide slot 360 when the depth adjustment lever 300 moves in the upward direction Z.

In this case, the guide protrusion 114 of the lumbar frame may protrude separately from the vertical rib 113. Alternatively, the guide protrusion 114 may be integrated with the vertical rib so as to protrude from one of the plurality of vertical ribs.

The depth adjuster 200 is inserted into the accommodation hole 310, the guiders 112 of the lumbar frame 100 are inserted into the vertical guide holes 340, and then the depth adjustment lever 300 is assembled by flange screws 350 fastened to the guiders 112 so that the depth adjustment lever 300 may slide in the upward/downward directions Z and Z' while being prevented from separating from the lumbar frame 100. In this case, the handle 331 of the main body is exposed to a lower side of the lumbar frame 100, the guide protrusions 114 of the lumbar frame are inserted into the guide slots 360.

When the depth adjustment lever 300 assembled as described above moves in the upward/downward directions Z and Z', the vertical guide holes 340 are moved relative to the guiders 112, and the guide slots 360 are moved relative to the guide protrusions 114.

In this case, the depth adjustment lever 300 slides upward or downward when the lever main body 330 is in contact with and supported by the plurality of vertical ribs 113 provided on the lumbar frame, such that the frictional resistance is minimized, and clearances in the forward/rearward directions Y and Y' and the upward/downward directions Z and Z' are prevented.

In addition, because the guide slots 360 of the main body of the depth adjustment lever 300 slide in the upward/downward directions Z and Z' along the guide protrusions 114 of the lumbar frame, the operability of the depth adjustment lever 300 is improved, and a clearance of the depth adjustment lever 300 is further prevented.

The pad support part 400 includes: a lumbar bracket 410 inserted into and connected to the horizontal movable member 220 of the depth adjuster so as to be movable in the upward/downward directions Z and Z' and assembled and coupled to the lumbar pad 500; and a lumbar plate 420 screw-coupled to the lumbar bracket 410 and configured to prevent the lumbar bracket 410 from separating from the horizontal movable member 220.

The lumbar bracket 410 includes: a center bracket 411 fitted with and connected to the horizontal movable member 220 so as to be slidable in the upward/downward directions Z and Z'; and blade brackets 412 integrally connected to two opposite sides of the center bracket 411 and fitted with and coupled to the lumbar pad 500. That is, the lumbar bracket 410 is formed such that the blade brackets 412 for providing a predetermined elastic force are integrally connected to the two opposite sides of the center bracket 411.

In this case, in the lumbar bracket 410, the blade brackets 412 positioned at the two opposite sides of the center bracket 411 each have a predetermined curvature, such that a deformation space portion 430 is formed between the lumbar pad 500 and the center bracket 411.

In the lumbar bracket 410 configured as described above, when the load is transmitted through the lumbar pad 500, the two opposite blade brackets 412 coupled to the lumbar pad 500 are elastically deformed in the direction of the center bracket 411 relative to the center bracket 411 so that the lumbar pad 500 may be supported while surrounding the waist portion of the seated user.

The center bracket 411 includes: a center groove 413 having a predetermined depth so as to be opened in the direction of the lumbar pad; the pair of vertical waveform rails 414 symmetrically formed and positioned in the center groove 413; and vertical slide holes 415 formed through two opposite sides of the center bracket so as to communicate with the center groove 413 and configured such that one side of the horizontal movable member is inserted into the vertical slide holes 415.

The center groove 413 serves to provide a space into which the insertion protrusions 222 of the horizontal movable member may be inserted and moved in the upward/downward direction.

The elastic pieces 223 provided on the insertion protrusions 222 of the horizontal movable member come into elastic contact with the vertical waveform rails 414. The vertical waveform rail has a crest portion (convex portion) and a trough portion (concave portion) that are repeatedly and continuously formed while defining a waveform so as to be exposed through the vertical slide hole 415. That is, the vertical waveform rail 414 is formed such that the crest portion (convex portion) and the trough portion (concave portion) are directed toward the vertical slide hole 415.

The vertical slide hole 415 slides in the upward/downward directions Z and Z' relative to the insertion protrusion 222 of the horizontal movable member. The vertical slide hole 415 has an opening port **415*a* formed at a lower side thereof, and the opening port 415*a* communicates with the center groove 413 so that the insertion protrusion 222 of the horizontal movable member may be fitted with and inserted into the opening port 415*a* from below to above. In this case, the opening port 415*a* has one side inner surface 415*b* extending from the crest portion (convex portion) or the trough portion (concave portion) of the vertical waveform rail 414**.

The blade brackets 412 include: first brackets 416 integrally connected to lower ends of the two opposite sides of the center bracket 411; second brackets 417 each having a predetermined angle with respect to the first bracket and integrally connected to upper sides of the first brackets; and coupling protrusions 418 protruding from the second brackets 417 and coupled to the lumbar pad 500.

For example, in the blade bracket 412, the first bracket 416 and the second bracket 417 define an L shape and are integrally connected to the center bracket 411. The coupling protrusion 418 may protrude from an upper side of the second bracket 417 and be coupled to the lumbar pad 500.

The lumbar plate 420 has limit protrusions 421 protruding to be fastened and fixed to the center bracket 411 to close the center groove 413 and the opening ports **415*a* positioned at the lower ends of the vertical slide holes. The limit protrusions 421 close the opening port 415*a* at the lower end to restrict the movement range of the lumbar bracket 410** in the upward direction Z.

The lumbar plate 420 is fastened and fixed to the center bracket 411 to close one open side of the center groove 413 and serves to prevent insertion protrusion 222 of the horizontal movable member inserted into the vertical slide holes 415 of the lumbar bracket from separating through the opening ports **415*a*, block introduction of foreign substances between the vertical slide holes 415 and the vertical waveform rails 414, and allow the lumbar bracket 410 to smoothly slide in the upward/downward directions Z and Z' relative to the insertion protrusions 222** of the horizontal movable member.

In addition, the lumbar plate 420 further has the vertical guides 422 formed in one surface directed toward the lumbar bracket 410, and the vertical guides 422 move while being inserted into the concave-convex guides **222*a* provided in the insertion protrusions 222** of the horizontal movable member.

In case that the vertical guides 422 are further provided in the lumbar plate 420 as described above, the vertical guides 422 of the lumbar plate slide in the upward/downward directions Z and Z' while engaging with the concave-convex guides 222*a* of the insertion protrusions when the lumbar pad 500 moves in the upward/downward directions Z and Z'. Therefore, the operability of the lumbar pad is more stably implemented, and no clearance occurs.

That is, in the vertical guides 422 provided in the lumbar plate, the concave portion is inserted into the convex portion of the concave-convex guide 222*a* provided in the insertion protrusion, and the convex portion is inserted into the concave portion of the concave-convex guide 222*a*. Therefore, at the time of adjusting the height of the lumbar pad 500, the vertical guide 422 of the lumbar pad may slide relative to the concave-convex guide 222*a* of the insertion protrusion.

The insertion protrusions 222 of the horizontal movable member of the depth adjuster are inserted into the vertical slide holes 415 of the lumbar bracket through the opening ports 415*a*, and then the lumbar plate 420 is screw-fixed to the lumbar bracket 410, such that the pad support part 400 configured as described above is assembled to close the opening ports 415*a* of the vertical slide holes.

When the lumbar plate 420 is assembled to the lumbar bracket 410 as described above, two opposite ends 411*a* of the center bracket of the lumbar bracket are slidably inserted into the guide grooves 224 of the horizontal movable member, the insertion protrusions 222 of the horizontal movable member are positioned in the center groove 413 of the lumbar bracket, the elastic pieces 223 of the insertion protrusions come into elastic contact with the vertical waveform rails 414, such that the pad support part 400 slides stepwise in the upward/downward directions Z and Z' relative to the insertion protrusions 222. In addition, because the opening ports 415*a* of the vertical slide holes are closed by the lumbar plate 420, the horizontal movable member 220 and the lumbar bracket 410 are prevented from being separated through the opening ports 415*a*.

The lumbar pad 500 is configured to be in contact with and supported by the user's waist. Two opposite ends of the lumbar pad 500 are fitted with and coupled to the pad support part 400 and each have a curved surface so that the lumbar pad 500 may be stably supported on the waist of the seated user.

That is, the lumbar pad 500 has coupling rings 510 protruding from two opposite ends of one surface directed toward the lumbar frame. The coupling protrusions 418 of the lumbar bracket of the pad support part are fitted with and coupled to the coupling rings 510.

In addition, the lumbar pad 500 further has guide inclination projections 520 connected to the coupling rings 510 and configured to guide the coupling protrusions 418 of the lumbar bracket to the coupling rings 510. That is, in the lumbar pad 500 according to the present disclosure, the coupling ring 510 is fitted with and coupled to the coupling protrusion 418 of the lumbar bracket from above to below. When the lumbar pad 500 is fitted and coupled, the guide inclination projection 520 comes into contact with the coupling protrusion 418 and moves downward along the coupling protrusion 418, such that the coupling ring 510 is easily caught and supported by the coupling protrusion 418.

In addition, the lumbar pad 500 has support brackets 530 protruding from the lower end of one surface on which the coupling rings 510 are provided. The support brackets 530 are inserted into the lumbar bracket 410 of the pad support part 400. The lumbar pad 500 and the lumbar bracket 410 are integrally coupled when the coupling rings 510 are fitted and the support brackets 530 are inserted and supported.

In addition, the support brackets 530 may be screw-fastened to the lumbar bracket 410. In case that the support brackets 530 are screw-fastened to the lumbar bracket 410 as described above, the lumbar pad 500 and the pad support part 400 are more stably coupled. In this case, the support bracket 520 is screw-coupled to the center bracket 411 of the lumbar bracket or a connection portion between the center bracket 411 and the blade bracket 412.

The lumbar pad 500 configured as described above may be made of a soft material that provides a predetermined elastic force so that the lumbar pad 500 is deformed in a shape that surrounds the waist of the seated user when the waist of the seated user comes into contact with the lumbar pad 500 and a load is generated.

FIGS. 13A, 13B, 13C, and 13D are exemplified views illustrating states in which the height of the lumbar pad according to the present disclosure is adjusted. When the lumbar pad moves in the upward/downward directions Z and Z' in the state in which the user is seated on the chair, the lumbar pad 500 and the pad support part 400 move in the upward/downward directions Z and Z' relative to the depth adjuster 300, such that the height of the lumbar pad 500 is adjusted stepwise.

In this case, the vertical waveform rails 414 provided on the lumbar bracket 410 of the pad support part come into elastic contact with the elastic pieces 223 provided on the horizontal movable member of the depth adjuster and move in the upward/downward directions Z and Z', and the elastic pieces 223 are fitted with and come into elastic contact with the trough portions (concave portions) of the vertical waveform rails 414, such that the height position of the lumbar pad 400 is fixed.

Figure 13A:
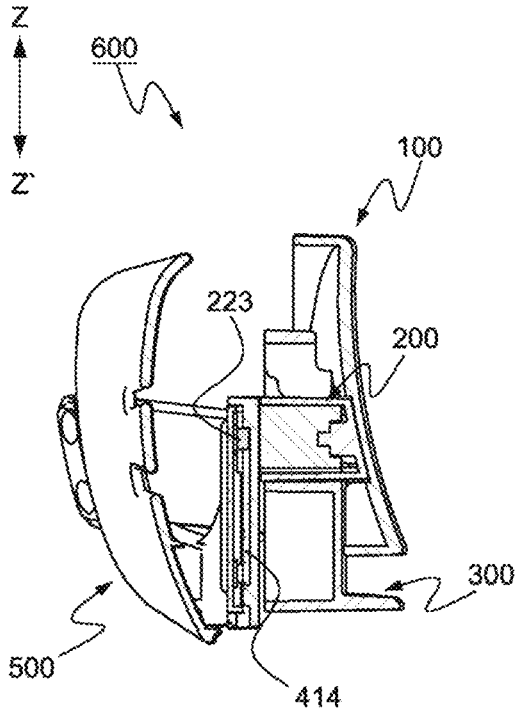
FIG. 13A is an exemplified view illustrating a state in which the lumbar pad according to the present disclosure is positioned at a lowermost end.

FIG. 13A is a view illustrating a state (basic height state) in which the lumbar pad 500 is positioned at the lowermost end. The elastic pieces 223 of the horizontal movable member come into elastic contact with the trough portions (concave portions) positioned at the upper side of the vertical waveform rails 414, such that the position of the lumbar pad 500 is fixed.

Figure 13B:
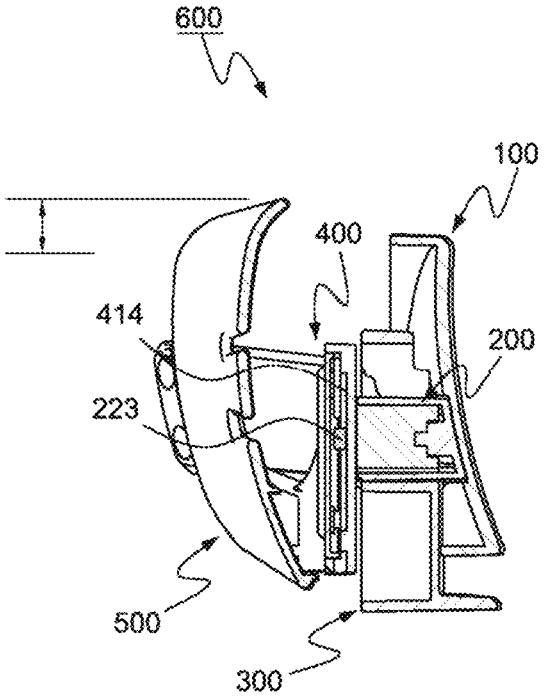
FIG. 13B is an exemplified view illustrating a state in which the lumbar pad according to the present disclosure is moved upward.

FIG. 13B is a view illustrating a state in which the lumbar pad 500 is moved in the upward direction Z. When the lumbar pad 500 is pulled in the upward direction Z, the vertical waveform rails 414 move upward, and the elastic pieces 223 of the horizontal movable member come into elastic contact with other trough portions (concave portions) of the vertical waveform rails 414, such that the height position of the lumbar pad 400 is fixed.

Figure 13C:
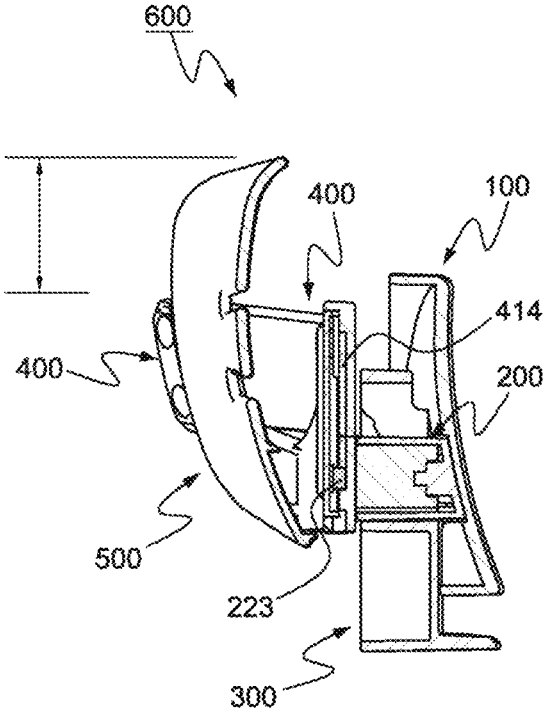
FIG. 13C is an exemplified view illustrating a state in which the lumbar pad according to the present disclosure is positioned at an uppermost end.

FIG. 13C is a view illustrating a state in which the lumbar pad 500 is positioned at the uppermost end. The elastic pieces 223 of the horizontal movable member come into elastic contact with the trough portions (concave portions) positioned at the lower side of the vertical waveform rails 414, such that the position of the lumbar pad 500 is fixed.

As illustrated in FIGS. 13A, 13B, 13C, and 13D, when the lumbar pad is moved in the upward/downward directions Z and Z', the lumbar pad 500 moves stepwise in the upward/downward directions Z and Z' within the range of the vertical waveform rails 414, such that the height of the lumbar pad 500 is adjusted stepwise in multiple stages as the lumbar pad 500 moves.

Figure 14A:
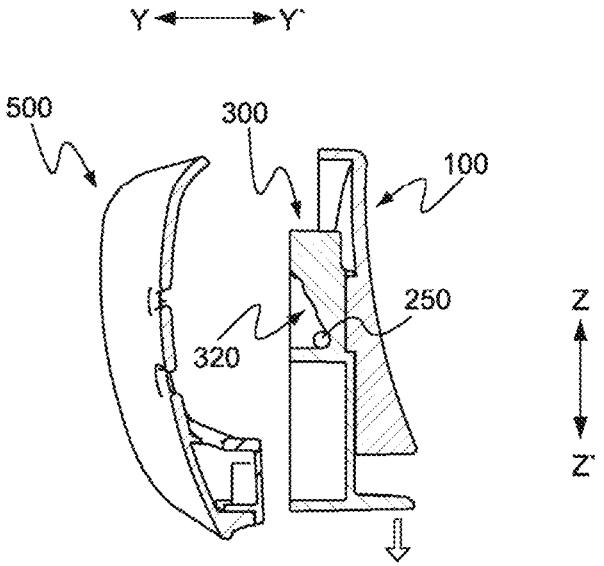
FIG. 14A is an exemplified view illustrating a state in which the lumbar pad according to the present disclosure is maximally moved in a direction of the lumbar frame.
Figure 14B:
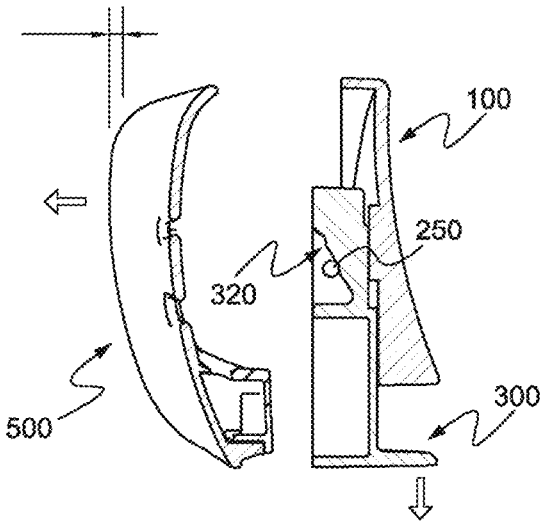
FIG. 14B is an exemplified view illustrating a state in which the lumbar pad according to the present disclosure is moved forward at a first step.
Figure 14C:
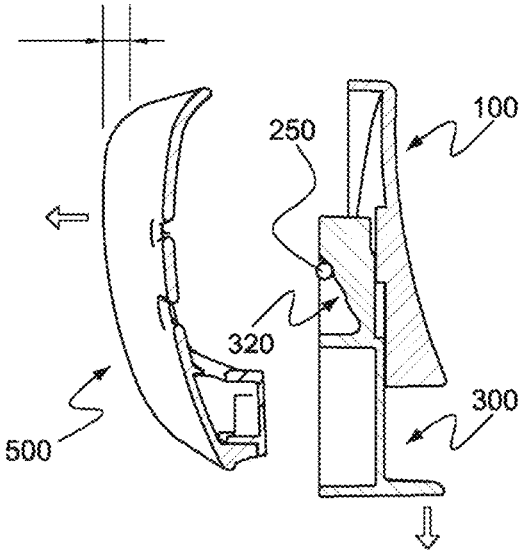
FIG. 14C is an exemplified view illustrating a state in which the lumbar pad according to the present disclosure is moved forward at a second step.

FIGS. 14A, 14B, and 14C are exemplified views illustrating states in which the depth of the lumbar pad according to the present disclosure is adjusted. FIG. 14A illustrates a state in which the lumbar pad 500 is maximally moved in the direction of the lumbar frame 100, i.e., a state (basic state) in which the lumbar pad 500 is maximally moved in the rearward direction Y'. The operating pins 250 are seated and supported on the lower catching projections 321 of the multi-stage support rails 320. In this case, the depth adjustment lever 300 is positioned at the uppermost end.

FIG. 14B illustrates a state (first step adjustment state) in which the lumbar pad 500 is moved in the forward direction Y at a first step. When the handle 331 of the depth adjustment lever is moved in the downward direction Z' in the state in which the user is seated on the chair, the multi-stage support rail 320 is moved in the downward direction Z', and the operating pin 250 moves while coming into contact with the downward inclined guide 323 of the multi-stage support rail being moved in the downward direction Z' and is seated on the upper catching projection 322".

In this case, in case that the operating pin 250 moves along the downward inclined guide 323, the operating pin 250 moves in the forward direction Y together with the horizontal movable member 220 while compressing the elastic body 240, and the pad support part 400 and the lumbar pad 500 are moved in the forward direction Y at the first step by the movement of the horizontal movable member 220.

When the force applied to the depth adjustment lever 300 is eliminated in the state in which the operating pin 250 is seated and supported on the upper catching projection 322", a frictional force is applied to the operating pin 250 and the upper catching projection 322" by the elastic force of the elastic body, such that the height of the lumbar pad 500 is supported, and the position of the depth adjustment lever is supported.

FIG. 14C illustrates a state (second step adjustment state) in which the lumbar pad 500 is moved in the forward direction Y at a second step. When the handle 331 of the depth adjustment lever is moved again in the downward direction Z' in the state in which the user is seated on the chair, the multi-stage support rail 320 is moved again in the downward direction Z', and the operating pin 250 is moved from the upper catching projection 322" along the downward inclined guide 323 and seated and supported on another upper catching projection 322'. In this case, the depth adjustment lever 300 is positioned at the lowermost end.

When the operating pin 250 is moved from the upper catching projection 322" and seated on another upper catching projection 322' as described above, the operating pin 250 is moved in the forward direction Y, such that the pad support part 400 and the lumbar pad 500 are moved in the forward direction Y at the second step.

FIG. 15 is an exemplified view illustrating a configuration of a chair according to the present disclosure. The lumbar supporting system 600 according to the present disclosure is installed in the backrest frame 700 of the chair. That is, the lumbar supporting system 600 is fixed as the two opposite ends of the lumbar frame 100 are screw-coupled to the backrest frame 700. In this case, a mesh backrest may be installed on the backrest frame 700. When the lumbar pad moves upward or downward and the depth adjustment lever moves upward or downward, the lumbar pad moves while deforming the mesh backrest, such that the height and depth of the lumbar pad are adjusted to be suitable for the body type of the seated user.

Figure 16:
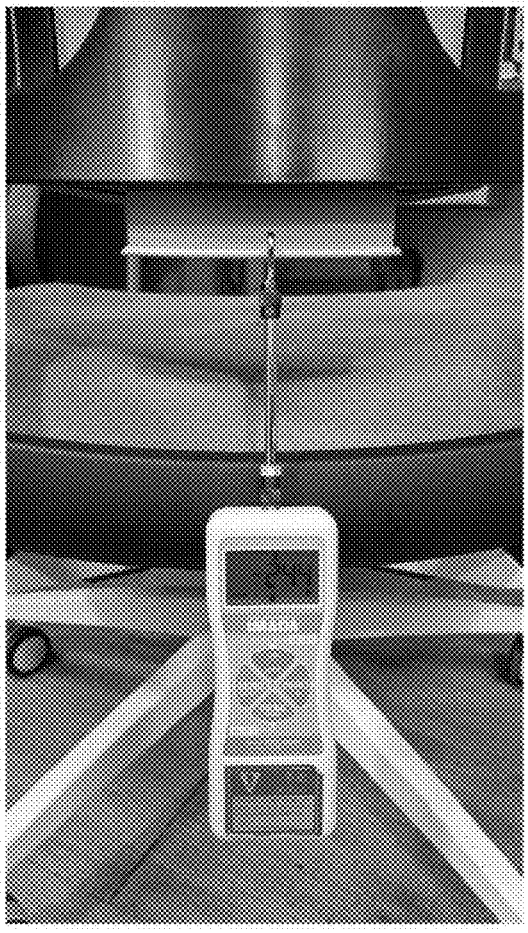
FIG. 16 is an exemplified photograph illustrating an operating force test according to the present disclosure.
Figure 16:
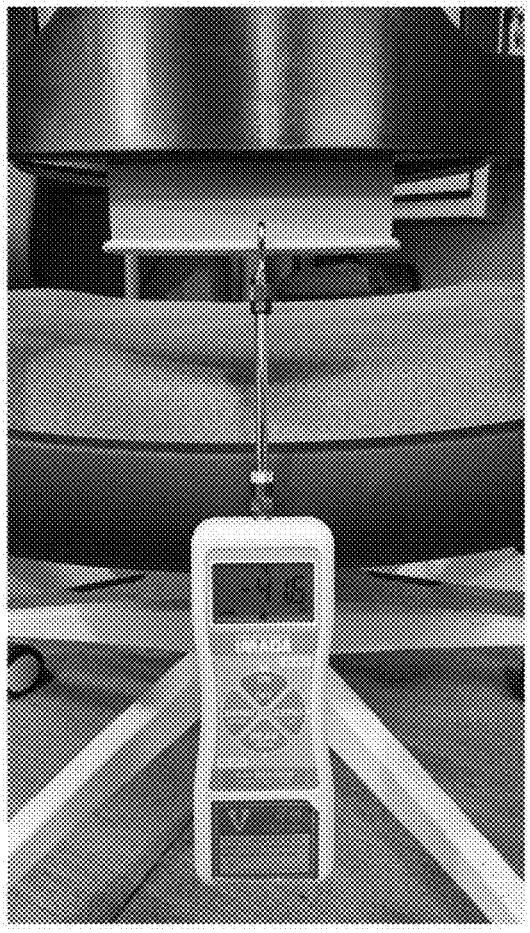

FIG. 16 is an exemplified photograph illustrating an operating force test according to the present disclosure. A vertical operating force of about 24 to 26 N was required for the depth adjustment lever to adjust the depth at the first step. A vertical operating force of about 40 to 42 N was required for the depth adjustment lever to adjust the depth at the second step. In this case, a compression spring having a compressive force (about 5 kgf) was assembled as the elastic body. The difference in vertical operating force between the first step adjustment and the second step adjustment of the depth adjustment lever depend on a degree to which the elastic body is compressed.

As described above, according to the present disclosure, the depth of the lumbar pad is adjusted as the depth adjustment lever is operated upward or downward by a low vertical operating force less than about 45 N. Therefore, it can be seen that the user may easily adjust the depth of the lumbar pad only by using one hand in the state in which the user is seated on the chair.

The present disclosure is not limited to the specific embodiment described above, various modifications can be made by any person skilled in the art to which the present disclosure pertains without departing from the subject matter of the present disclosure as claimed in the claims, and the modifications are within the scope defined by the claims.

In addition, the terms used to describe the present disclosure are used only for the purpose of distinguishing one constituent element from another constituent element and assisting in understanding the present disclosure, and the constituent elements of the present disclosure should not be limited by the terms.

What is claimed is:

1. A lumbar supporting system of a chair, the lumbar supporting system comprising:

a lumbar frame (100) having two opposite ends fixedly installed on a backrest frame (700) of a chair (800);

a depth adjuster (200) including a guide cover (210) fixedly installed on the lumbar frame (100), and a horizontal movable member (220) installed to be inserted into the guide cover (210) so as to slide in forward/rearward directions (Y) and (Y');

an depth adjustment lever (300) including an accommodation hole (310) configured to accommodate the depth adjuster (200), and multi-stage support rails (320) provided at two opposite ends of the accommodation hole and configured to be in contact with and supported by one side of the lumbar frame (100) and to move in upward/downward directions (Z) and (Z'), the multi-stage support rails (320) being configured such that operating pins (250) fixedly installed at two opposite sides of the horizontal movable member (220) are in contact with and supported by the multi-stage support rails (320);

a pad support part (400) including vertical waveform rails (414) configured to be in elastic contact with elastic pieces (223) provided on the horizontal movable member (220) of the depth adjuster, the pad support part (400) being connected to and installed on the horizontal movable member (220) and configured to be slidable in the upward/downward directions (Z) and (Z'); and a lumbar pad (500) fitted with and coupled to two opposite ends of the pad support part (400) and configured to come into elastic contact with a waist of a seated user, wherein the horizontal movable member (220) is horizontally moved in the forward/rearward directions (Y) and (Y') by the movement of the depth adjustment lever (300) in the upward/downward directions (Z) and (Z'), such that a depth of the lumbar pad (500) in the forward/rearward direction is adjusted, and wherein a height of the lumbar pad (500) is adjusted by the movement of the pad support part (400) in the upward/downward directions (Z) and (Z') based on the horizontal movable member (220).

2. The lumbar supporting system of claim 1, wherein the lumbar frame (100) comprises:

a center frame (110) to which the guide cover (210) of the depth adjuster (200) is screw-fastened and integrally fixed; and blade frames (120) integrated with two opposite sides of the center frame (110) and each having an end fixedly installed on the backrest frame (800) of the chair, and wherein the center frame (110) comprises:

cover fasteners (111) to which the guide cover (210) of the depth adjuster is screw-fastened;

guiders (112) protruding to be symmetric with respect to the cover fasteners (111) and configured to prevent withdrawal of the depth adjustment lever (300) while guiding the movement of the depth adjustment lever (300) in the upward/downward directions (Z) and (Z'); and a plurality of vertical ribs (113) protruding to be in contact with and supported by one surface of the depth adjustment lever (300).

3. The lumbar supporting system of claim 1, wherein the depth adjuster (200) comprises:

the guide cover (210) fixedly installed on the lumbar frame (100);

the horizontal movable member (220) installed to be inserted into the guide cover (210) and configured to be movable horizontally in the forward/rearward directions (Y) and (Y');

a limit bolt (230) configured to penetrate the horizontal movable member (220) and having an end fixedly installed on the guide cover (210);

an elastic body (240) installed in the horizontal movable member (220) and having a first side configured to be in contact with and supported by a bolt head (231) of the limit bolt and a second side configured to be in contact with and supported by one side of the horizontal movable member (220); and the operating pins (250) fastened to two opposite surfaces of the horizontal movable member (220) while penetrating side long holes (211) formed in two opposite surfaces of the guide cover (210).

4. The lumbar supporting system of claim 1, wherein the guide cover (210) has a horizontal slide hole (212) into which the horizontal movable member (220) is inserted to be horizontally movable in the forward/rearward directions (Y) and (Y'), wherein the side long holes (211) are formed through the two opposite surfaces of the guide cover (210) and communicate with the horizontal slide hole (212), and wherein the horizontal movable member (220) comprises:

a main body (221) slidably inserted into the horizontal slide hole (212) of the guide cover (210) and fastened to operating pins (250) through the side long holes (211);

a pair of insertion protrusions (222) protruding from two opposite sides of one surface of the main body while facing each other so as to define guide grooves (224) into which one side of the pad support part (400) is inserted; and the elastic pieces (223) integrated with ends of the insertion protrusions (221) facing each other and provided to be in elastic contact with one side of the pad support part (400).

5. The lumbar supporting system of claim 4, wherein the main body (221) of the horizontal movable member further has nut insertion holes (221*a*) into which fastening nuts (227) are inserted and installed, and wherein the fastening nuts (227) are inserted and installed into the nut insertion holes (221*a*) so that the operating pins (250) are fastened to the fastening nuts (221*a*) through fastening holes (226).

6. The lumbar supporting system of claim 4, wherein horizontal guides (214) protrude in the horizontal slide hole (212) of the guide cover (21), and the main body (221) of the horizontal movable member has slide grooves (221*b*) corresponding to the horizontal guides (214), such that when the horizontal movable member (220) slides in the forward/rearward directions (Y) and (Y') in the horizontal slide hole (212) of the guide cover, the horizontal movable member (220) moves along the horizontal guides (214) of the guide cover (21).

7. The lumbar supporting system of claim 1, wherein the depth adjustment lever (300) comprises:

a lever main body (330) having a handle (331) formed at a lower end thereof;

an accommodation hole (310) formed through the lever main body (330) and configured to accommodate the depth adjuster (200);

the multi-stage support rails (320) formed on the lever main body (330) and positioned at the two opposite ends of the accommodation hole (310); and vertical guide holes (340) formed through the lever main body (330) so that one side of the lumbar frame is inserted into the vertical guide holes (340).

8. The lumbar supporting system of claim 7, wherein the depth adjustment lever (300) further has guide slots (360) formed in one surface of the lever main body, and guide protrusions (114) further protrude from the lumbar frame (100), such that the guide slots (360) of the depth adjustment lever move along the guide protrusions (114) of the lumbar frame when the depth adjustment lever (300) slides in the upward/downward directions (Z) and (Z').

9. The lumbar supporting system of claim 1, wherein the multi-stage support rails (320) are positioned in rail grooves (370) formed at two opposite sides of the accommodation hole (310) and configured to communicate with the accommodation hole (310), and wherein the multi-stage support rail (320) comprises:

a lower catching projection (321) configured such that the operating pin (250) of the depth adjuster is in contact with and supported by the lower catching projection (321), the lower catching projection (321) being configured to restrict the movement of the depth adjustment lever in the upward direction (Z);

a plurality of upper catching projections (322) positioned above the lower catching projection (321) and configured such that the operating pin (250) of the depth adjuster is in contact with and supported by the plurality of upper catching projections (322); and downward inclined guides (323) formed between the lower catching projection (321) and a first upper catching projection of the plurality of upper catching projections (322), and between neighboring two upper catching projections of the plurality of upper catching projections.

10. The lumbar supporting system of claim 9, wherein the lower catching projection (321) comprises:

a stopper surface (321*a*) provided to be in contact with and supported by the operating pin (250) and configured to restrict the movement of the depth adjustment lever in the upward direction (Z); and a support surface (321*b*) provided to be in contact with and supported by the operating pin (250) and configured to restrict the movement of the lumbar pad (500) in the rearward direction (Y'), wherein the stopper surface (321*a*) is formed to allow the operating pin (250) to move horizontally, and wherein the support surface (321*b*) is formed to be in contact with and supported by the operating pin (250) while surrounding an outer surface of the operating pin (250).

11. The lumbar supporting system of claim 9, wherein each of the upper catching projections (322) has a height (h) of about 0.5 to 1.0 times a diameter (D) of the operating pin (250), each of the downward inclined guides (323) is formed to have a downward inclination angle (θ) of about 120° to 160° with respect to an upper catching projection (322) connected to an upper end of said each of the downward inclined guides, and the lower catching projection (321) has the same diameter as the operating pin (250) so that the operating pin (250) of the depth adjuster is seated and supported on the lower catching projection (321) in a state in which a periphery of an outer surface of the operating pin (250) of the depth adjuster is in surface contact with the lower catching projection (321).

12. The lumbar supporting system of claim 9, wherein each of the plurality of upper catching projections (322) has a vertical flat surface in a predetermined section.

13. The lumbar supporting system of claim 9, wherein each of the plurality of upper catching projections (322) comprises:

a contact curved surface (322*b*) with which a periphery of an outer surface of the operating pin (250) is in surface contact; and a vertical flat surface (322*c*) extending from the contact curved surface (322*b*), and wherein the vertical flat surface (322*c*) is positioned below the contact curved surface (322*b*).

14. The lumbar supporting system of claim 13, wherein the contact curved surface (322*b*) has a curved surface length corresponding to a length of an arc having a central angle (θ1) of 25° to 45° with respect to a center (O) of the operating pin when the operating pin (250) is in contact with and supported by the contact curved surface (322*b*), wherein the vertical flat surface (322*c*) is formed at a lower side of the contact curved surface (322*b*) and integrally extends from the contact curved surface (322*b*) while having a length of 0.1 to 0.5 times a diameter (D) of the operating pin, and wherein an upper end of the contact curved surface (322*b*) is connected to a downward inclined guide (323) formed at an upper side of the contact curved surface, and a lower end of the vertical flat surface (322*c*) is connected to a downward inclined guide (323) formed at a lower side of the contact curved surface.

15. The lumbar supporting system of claim 1, wherein the pad support part (400) comprises:

a lumbar bracket (410) inserted into and connected to the horizontal movable member (220) of the depth adjuster so as to be movable in the upward/downward directions (Z) and (Z') and assembled and coupled to the lumbar pad (500); and a lumbar plate (420) screw-coupled to the lumbar bracket (410) and configured to prevent the lumbar bracket (410) from separating from the horizontal movable member (220), and wherein the lumbar bracket (410) comprises:

a center bracket (411) fitted with and connected to the horizontal movable member (220) so as to be slidable in the upward/downward directions (Z) and (Z'); and blade brackets (412) integrally connected to two opposite sides of the center bracket (411) and fitted with and coupled to the lumbar pad (500).

16. The lumbar supporting system of claim 15, wherein the center bracket (411) of the lumbar bracket (410) comprises:

a center groove (413) having a predetermined depth so as to be opened in a direction of the lumbar pad;

the pair of vertical waveform rails (414) symmetrically formed and positioned in the center groove (413) and configured such that one side of the horizontal movable member (220) is in elastic contact with and supported by the pair of vertical waveform rails (414); and vertical slide holes (415) formed through two opposite sides of the center bracket so as to communicate with the center groove (413) and configured such that one side of the horizontal movable member is inserted into the vertical slide holes (415), and wherein the lumbar plate (420) has limit protrusions (421) protruding from a lower end of the lumbar plate (420), the limit protrusions (421) being configured to close opening ports (415*a*) to restrict a movement range of the lumbar bracket (410) in the upward direction (Z).

17. The lumbar supporting system of claim 16, wherein the lumbar plate (420) further has vertical guides (422) provided in one surface directed toward the lumbar bracket (410), and the horizontal movable member further has concave-convex guides (222*a*) corresponding to the vertical guides (422), and wherein when the lumbar bracket moves in the upward/downward directions (Z) and (Z'), the vertical guides (422) of the lumbar plate move along the concave-convex guides (222*a*) of the horizontal movable member.

18. The lumbar supporting system of claim 1, wherein the lumbar pad (500) has coupling rings (510) protruding from two opposite ends of one surface directed toward the lumbar frame, coupling protrusions (418) are formed at one side of the pad support part, and the coupling protrusions (418) of the pad support part are fitted with and coupled to the coupling rings (510) of the lumbar pad.

19. The lumbar supporting system of claim 18, wherein the lumbar pad (500) further has guide inclination projections (520) connected to the coupling rings (510) and configured to guide the coupling protrusions (418) of the lumbar bracket to the coupling rings (510).

20. A chair comprising:

a lumbar supporting system according to claim 1, the lumbar supporting system being installed on a backrest frame of the chair.

* * * * *